US008182552B2

(12) United States Patent
Janssen et al.

(10) Patent No.: US 8,182,552 B2
(45) Date of Patent: May 22, 2012

(54) PROCESS FOR DYEING A TEXTILE WEB

(75) Inventors: Robert Allen Janssen, Alpharetta, GA (US); Dennis John DeGroot, Appleton, WI (US); Thomas David Ehlert, Neenah, WI (US); Michael Joseph Garvey, Appleton, WI (US); Earl C. McCraw, Jr., Duluth, GA (US); Patrick Sean McNichols, Hortonville, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 508 days.

(21) Appl. No.: 11/777,128

(22) Filed: Jul. 12, 2007

(65) Prior Publication Data

US 2008/0155766 A1 Jul. 3, 2008

Related U.S. Application Data

(63) Continuation-in-part of application No. 11/617,473, filed on Dec. 28, 2006.

(51) Int. Cl.
*D06P 5/20* (2006.01)

(52) U.S. Cl. ..... 8/444; 28/169

(58) Field of Classification Search ..... 8/494, 636, 8/444; 28/178, 169

See application file for complete search history.

(56) References Cited

U.S. PATENT DOCUMENTS 2,904,981 A 9/1959 Macomson
3,032,460 A 5/1962 Chipman et al.
3,202,281 A 8/1965 Weston
3,249,453 A 5/1966 Schnoring et al.
3,273,631 A 9/1966 Neuman
3,275,787 A 9/1966 Newberry
3,325,348 A 6/1967 Bennett
3,338,992 A 8/1967 Kinney
3,341,394 A 9/1967 Kinney
3,410,116 A * 11/1968 Levinson ..... 68/3 R
3,471,248 A 10/1969 Schaeuble
3,490,584 A 1/1970 Balamuth
3,502,763 A 3/1970 Hartman (Continued)

FOREIGN PATENT DOCUMENTS

DE 2056104 5/1972

(Continued)

OTHER PUBLICATIONS

Copending U.S. Appl. No. 11/617,473.*

(Continued)

*Primary Examiner* — Harold Pyon
*Assistant Examiner* — Katie L Hammer
(74) *Attorney, Agent, or Firm* — Armstrong Teasdale LLP

(57) ABSTRACT

In a process for dyeing a textile web having a first face and a second face opposite the first face, dye is applied to the textile web and the web is then moved in an open configuration thereof over a contact surface of an ultrasonic vibration system with the textile web in direct contact with the contact surface of the ultrasonic vibration system. The ultrasonic vibration system is operated to impart ultrasonic energy to the textile web to facilitate the distribution of dye throughout the web. The web is then moved further in its open configuration through a microwave application chamber of a microwave system and the microwave system is operated to impart microwave energy to the web in the microwave application chamber to facilitate binding of the dye to the web.

25 Claims, 10 Drawing Sheets

U.S. PATENT DOCUMENTS 3,519,517 A 7/1970 Dench
3,542,615 A 11/1970 Dobo et al.
3,584,389 A 6/1971 Hilton et al.
3,620,875 A 11/1971 Guglielmo, Sr. et al.
3,620,876 A 11/1971 Guglielmo, Sr. et al.
3,653,952 A 4/1972 Gagliardi
3,672,066 A 6/1972 Stephansen
3,673,140 A 6/1972 Ackerman et al.
3,692,618 A 9/1972 Dorschner et al.
3,707,773 A 1/1973 Wolfberg et al.
3,762,188 A 10/1973 Bernholz et al.
3,782,547 A 1/1974 Dietert
3,802,817 A 4/1974 Matsuki et al.
3,289,328 A 8/1974 Blustain
3,849,241 A 11/1974 Butin et al.
3,888,715 A 6/1975 Fraser et al.
3,902,414 A 9/1975 Zimmer
3,932,129 A 1/1976 Porter
4,046,073 A 9/1977 Mitchell et al.
4,060,438 A 11/1977 Johnson
4,062,768 A 12/1977 Elliot
4,086,112 A 4/1978 Porter
4,131,424 A 12/1978 Cocoros
4,156,626 A 5/1979 Souder
4,210,674 A 7/1980 Mitchell
4,234,775 A 11/1980 Wolfberg et al.
4,242,091 A 12/1980 Feess et al.
4,260,389 A 4/1981 Lister
4,274,209 A 6/1981 Kawaguchi
4,302,485 A 11/1981 Last et al.
4,339,295 A 7/1982 Boretos et al.
4,340,563 A 7/1982 Appel et al.
4,365,422 A 12/1982 Kawaguchi
4,379,710 A 4/1983 Crounse
4,393,671 A 7/1983 Ito
4,413,069 A 11/1983 Marshall
4,419,160 A 12/1983 Wang et al.
4,425,718 A * 1/1984 Kawaguchi ..... 34/259
4,482,239 A 11/1984 Hosono et al.
4,483,571 A 11/1984 Mishiro
4,494,956 A 1/1985 Schafer et al.
4,511,520 A 4/1985 Bowen
4,548,611 A 10/1985 Paterson et al.
4,602,055 A 7/1986 Schafer et al.
4,612,016 A * 9/1986 Jaeger et al. ..... 8/543
4,626,642 A 12/1986 Wang et al.
4,662,969 A 5/1987 Wang
4,673,512 A 6/1987 Schram
4,693,879 A 9/1987 Yoshimura et al.
4,706,509 A 11/1987 Riebel
4,707,402 A 11/1987 Thorsrud
4,708,878 A 11/1987 Hagelauer et al.
4,743,361 A 5/1988 Schram
4,751,529 A 6/1988 Elrod et al.
4,861,342 A 8/1989 Danel
4,877,516 A 10/1989 Schram
4,879,011 A 11/1989 Schram
4,879,564 A 11/1989 Long
4,906,497 A 3/1990 Hellmann et al.
4,929,279 A 5/1990 Hays
4,945,121 A 7/1990 Micale et al.
4,969,968 A 11/1990 Leatherman
RE33,524 E 1/1991 Schram
4,991,539 A 2/1991 Sarda
4,992,636 A 2/1991 Namiki
5,002,587 A 3/1991 Berendt
5,006,266 A 4/1991 Schram
5,028,237 A 7/1991 Berendt
5,059,249 A 10/1991 Hays
5,169,571 A 12/1992 Buckley
5,171,387 A 12/1992 Wuchinich
5,189,078 A 2/1993 Johnson et al.
5,193,362 A 3/1993 Otto
5,193,913 A 3/1993 Rosenbaum
5,217,768 A 6/1993 Walters et al.
5,220,346 A 6/1993 Carreira et al.
5,238,975 A 8/1993 Johnson et al.
5,242,557 A 9/1993 Jones et al.
5,244,525 A 9/1993 Neuwirth et al.
5,246,467 A 9/1993 Cockett et al.
5,272,216 A 12/1993 Clark, Jr. et al.
5,338,611 A 8/1994 Lause et al.
5,340,649 A 8/1994 Roeker et al.
5,346,932 A 9/1994 Takahashi et al.
5,368,199 A 11/1994 Haas et al.
5,400,460 A 3/1995 Roeker et al.
5,423,260 A 6/1995 Goldberg et al.
5,442,160 A 8/1995 Kimrey, Jr. et al.
5,446,270 A 8/1995 Chamberlain et al.
5,451,446 A 9/1995 Kincaid et al.
5,466,722 A 11/1995 Stoffer et al.
5,487,853 A 1/1996 Buckley
5,500,668 A 3/1996 Malhotra et al.
5,536,921 A 7/1996 Hedrick et al.
5,543,605 A 8/1996 Kimrey, Jr. et al.
5,563,644 A 10/1996 Isganitis et al.
5,603,795 A 2/1997 Paulauskas et al.
5,631,685 A 5/1997 Gooray et al.
5,652,019 A 7/1997 Moran
5,709,737 A 1/1998 Malhotra et al.
5,770,296 A 6/1998 Remerowski et al.
5,798,395 A 8/1998 Lauf et al.
5,803,270 A 9/1998 Brodeur
5,804,801 A 9/1998 Lauf et al.
5,814,138 A 9/1998 Fague
5,831,166 A 11/1998 Kozuka et al.
5,851,274 A 12/1998 Lin
5,853,469 A 12/1998 Colt et al.
5,856,245 A 1/1999 Caldwell et al.
5,871,872 A 2/1999 Matijevic et al.
5,902,489 A 5/1999 Yasuda et al.
5,913,904 A 6/1999 Meyer et al.
5,916,203 A 6/1999 Brandon et al.
5,979,664 A 11/1999 Brodeur
5,984,468 A 11/1999 Malhotra
5,989,475 A 11/1999 Schulthess et al.
6,007,662 A 12/1999 Remerowski et al.
6,019,921 A 2/2000 Lutz
6,024,822 A 2/2000 Alper et al.
6,045,648 A 4/2000 Palmgren et al.
6,055,859 A 5/2000 Kozuka et al.
6,074,466 A 6/2000 Iwasa
6,089,702 A 7/2000 Hilton
6,103,812 A 8/2000 Wei et al.
6,114,676 A 9/2000 Jerby et al.
6,117,192 A 9/2000 Tate
6,129,767 A 10/2000 Hong
6,203,151 B1 3/2001 Ruhe
6,221,258 B1 4/2001 Feke et al.
6,254,787 B1 7/2001 Kimura et al.
6,266,836 B1 7/2001 Gallego Juarez et al.
6,303,061 B1 10/2001 Hewins
6,332,541 B1 12/2001 Coakley et al.
6,348,679 B1 2/2002 Ryan et al.
6,350,792 B1 2/2002 Smetana et al.
6,368,994 B1 4/2002 Sklyarevich
6,381,995 B1 5/2002 Hong
6,409,329 B1 6/2002 King
6,419,798 B1 7/2002 Topolkaraev et al.
6,425,663 B1 7/2002 Eastlund et al.
6,431,702 B2 8/2002 Ruhe
6,436,513 B1 8/2002 Kitamura et al.
6,444,964 B1 9/2002 Eastlund et al.
6,457,823 B1 10/2002 Cleary et al.
6,467,350 B1 10/2002 Kaduchak et al.
6,508,550 B1 1/2003 Eastlund et al.
6,566,414 B2 5/2003 Takeshima et al.
6,578,959 B1 6/2003 Seccombe
6,600,142 B2 7/2003 Ryan et al.
6,605,651 B1 8/2003 Stangel
6,646,026 B2 11/2003 Fan et al.
6,649,888 B2 11/2003 Ryan et al.
6,652,602 B2 11/2003 Yang et al.
6,663,239 B2 12/2003 Wotton et al.
6,673,178 B2 1/2004 Ellner et al.
6,683,287 B2 1/2004 Behnke et al.
6,686,573 B2 2/2004 Behnke et al.

| | | | | |
|---|---|---|---|---|
| 6,689,730 | B2 | 2/2004 | Hortel et al. | |
| 6,719,422 | B2 | 4/2004 | Wu et al. | |
| 6,734,409 | B1 | 5/2004 | Wang et al. | |
| 6,783,623 | B2 | 8/2004 | Morin et al. | |
| 6,822,135 | B2 | 11/2004 | Soerens et al. | |
| 6,846,448 | B2 | 1/2005 | Rymer et al. | |
| 6,855,760 | B1 | 2/2005 | Kirsten et al. | |
| 6,866,378 | B2 | 3/2005 | Wotton et al. | |
| 6,901,683 | B2 | 6/2005 | Lyle et al. | |
| 6,902,650 | B2 | 6/2005 | Park et al. | |
| 6,929,750 | B2 | 8/2005 | Laurell et al. | |
| 6,938,358 | B2 | 9/2005 | Lyle et al. | |
| 7,034,266 | B1 | 4/2006 | DeGroot et al. | |
| 3,484,179 | A1 | 1/2007 | Adams et al. | |
| 7,186,772 | B2 | 3/2007 | Berkau et al. | |
| 2001/0017102 | A1* | 8/2001 | Caldwell | 118/33 |
| 2002/0074380 | A1 | 6/2002 | Ellner et al. | |
| 2002/0079121 | A1 | 6/2002 | Ryan et al. | |
| 2002/0133888 | A1 | 9/2002 | Boyes | |
| 2002/0142106 | A1 | 10/2002 | Bethune et al. | |
| 2003/0116888 | A1 | 6/2003 | Rymer et al. | |
| 2003/0118814 | A1 | 6/2003 | Workman, Jr. et al. | |
| 2003/0118825 | A1 | 6/2003 | Melius et al. | |
| 2003/0119406 | A1 | 6/2003 | Abuto | |
| 2004/0065599 | A1 | 4/2004 | Lal et al. | |
| 2004/0130606 | A1 | 7/2004 | Tawaraya et al. | |
| 2004/0179076 | A1 | 9/2004 | Cohen et al. | |
| 2004/0222080 | A1 | 11/2004 | Tour et al. | |
| 2004/0232583 | A1 | 11/2004 | Monsheimer et al. | |
| 2005/0008560 | A1 | 1/2005 | Kataoka et al. | |
| 2005/0082234 | A1 | 4/2005 | Solenthaler | |
| 2005/0100812 | A1 | 5/2005 | Schultheis et al. | |
| 2005/0132906 | A1* | 6/2005 | Fernfors et al. | 101/32 |
| 2005/0202578 | A1 | 9/2005 | Yaniv et al. | |
| 2005/0235740 | A1 | 10/2005 | Desie et al. | |
| 2005/0238804 | A1 | 10/2005 | Garbar et al. | |
| 2008/0062811 | A1 | 3/2008 | Janssen et al. | |
| 2008/0063718 | A1 | 3/2008 | Janssen et al. | |
| 2008/0063806 | A1 | 3/2008 | Janssen et al. | |
| 2008/0155762 | A1 | 7/2008 | Janssen et al. | |
| 2008/0155763 | A1 | 7/2008 | Janssen et al. | |
| 2008/0156428 | A1 | 7/2008 | Janssen et al. | |

FOREIGN PATENT DOCUMENTS

| | | | |
|---|---|---|---|
| DE | 3325958 | | 2/1985 |
| DE | 4344455 | | 6/1995 |
| DE | 19703634 | | 10/1997 |
| DE | 29923223 | | 7/2000 |
| DE | 19911683 | | 9/2000 |
| DE | 19913179 | | 9/2000 |
| DE | 10245201 | | 4/2004 |
| DE | 10353804 | | 6/2005 |
| EP | 0041779 | A1 | 12/1981 |
| EP | 0063203 | A1 | 10/1982 |
| EP | 0065057 | A1 | 11/1982 |
| EP | 0065058 | A1 | 11/1982 |
| EP | 0003684 | B1 | 5/1983 |
| EP | 0031862 | B1 | 2/1984 |
| EP | 0141556 | A2 | 5/1985 |
| EP | 0170758 | A1 | 2/1986 |
| EP | 0188105 | A1 | 7/1986 |
| EP | 0212655 | | 3/1987 |
| EP | 0455265 | | 11/1991 |
| EP | 0459967 | | 12/1991 |
| EP | 0281041 | B1 | 9/1992 |
| EP | 0549542 | A1 | 6/1993 |
| EP | 0303803 | B1 | 6/1994 |
| EP | 0625606 | B1 | 11/1994 |
| EP | 0282015 | B1 | 6/1995 |
| EP | 0667245 | A1 | 8/1995 |
| EP | 0798116 | A1 | 10/1997 |
| EP | 0907423 | | 4/1999 |
| EP | 0969131 | A1 | 1/2000 |
| EP | 0984045 | | 3/2000 |
| EP | 1010796 | | 6/2000 |
| EP | 1010796 | B1 | 6/2000 |
| EP | 1029651 | | 8/2000 |
| EP | 1238034 | B1 | 12/2003 |
| EP | 1371697 | A2 | 12/2003 |
| EP | 1396316 | | 3/2004 |
| EP | 0984045 | B1 | 9/2004 |
| EP | 1541322 | A2 | 6/2005 |
| FR | 2175286 | | 10/1973 |
| FR | 2878536 | | 6/2006 |
| GB | 631882 | | 11/1949 |
| GB | 850365 | | 10/1960 |
| GB | 1124787 | | 8/1968 |
| GB | 1229200 | A | 4/1971 |
| GB | 1257807 | A | 12/1971 |
| GB | 1363277 | A | 8/1974 |
| GB | 1404575 | | 9/1975 |
| GB | 1466735 | | 3/1977 |
| GB | 1482755 | A | 8/1977 |
| GB | 1583953 | A | 2/1981 |
| GB | 2120497 | | 11/1983 |
| GB | 2350321 | A | 11/2000 |
| JP | 54068842 | A | 6/1979 |
| JP | 55107490 | A | 8/1980 |
| JP | 56028221 | | 3/1981 |
| JP | 57119853 | | 7/1982 |
| JP | 58034051 | | 2/1983 |
| JP | 59171682 | A | 9/1984 |
| JP | 60101090 | A | 6/1985 |
| JP | 61291190 | A | 12/1986 |
| JP | 63072364 | | 4/1988 |
| JP | 63104664 | | 5/1988 |
| JP | 63318438 | A | 12/1988 |
| JP | 1108081 | | 4/1989 |
| JP | 1163074 | A | 6/1989 |
| JP | 01213458 | | 8/1989 |
| JP | 1213486 | A | 8/1989 |
| JP | 2025602 | | 1/1990 |
| JP | 2167700 | A | 6/1990 |
| JP | 2220812 | A | 9/1990 |
| JP | 2262178 | A | 10/1990 |
| JP | 3036034 | A | 2/1991 |
| JP | 3086258 | | 4/1991 |
| JP | 3099883 | A | 4/1991 |
| JP | 3137283 | A | 6/1991 |
| JP | 3244594 | A | 10/1991 |
| JP | 4257445 | | 9/1992 |
| JP | 4257445 | A | 9/1992 |
| JP | 6228824 | | 8/1994 |
| JP | 7198257 | A | 8/1995 |
| JP | 7314661 | A | 12/1995 |
| JP | 8304388 | | 11/1996 |
| JP | 9286943 | | 11/1997 |
| JP | 10060331 | | 3/1998 |
| JP | 10112384 | A | 4/1998 |
| JP | 10112385 | A | 4/1998 |
| JP | 10112386 | A | 4/1998 |
| JP | 10112387 | A | 4/1998 |
| JP | 10315336 | A | 12/1998 |
| JP | 11034590 | A | 2/1999 |
| JP | 11133661 | | 5/1999 |
| JP | 2000144582 | A | 5/2000 |
| JP | 2000158364 | | 6/2000 |
| JP | 2001228733 | A | 8/2001 |
| JP | 2001252588 | | 9/2001 |
| JP | 2002210920 | A | 7/2002 |
| JP | 2004020176 | | 1/2004 |
| JP | 2004082530 | | 3/2004 |
| JP | 2004238012 | A | 8/2004 |
| JP | 2004256783 | | 9/2004 |
| JP | 2005118688 | | 5/2005 |
| WO | 8910258 | | 11/1989 |
| WO | 9117889 | | 11/1991 |
| WO | 9420833 | | 9/1994 |
| WO | 9620784 | | 7/1996 |
| WO | 9628599 | | 9/1996 |
| WO | 9743026 | | 11/1997 |
| WO | 9817373 | | 4/1998 |
| WO | 9822250 | | 5/1998 |
| WO | 9844058 | | 10/1998 |
| WO | 9961539 | | 12/1999 |
| WO | 0004978 | | 2/2000 |
| WO | 0026011 | | 5/2000 |
| WO | 0026026 | | 5/2000 |

| | | | |
|---|---|---|---|
| WO | 0029178 | | 5/2000 |
| WO | 0031189 | | 6/2000 |
| WO | 0041794 | | 7/2000 |
| WO | 0109262 | | 2/2001 |
| WO | 0110635 | | 2/2001 |
| WO | 0121725 | | 3/2001 |
| WO | 0136116 | A1 | 5/2001 |
| WO | 0136117 | A1 | 5/2001 |
| WO | 0250511 | | 6/2002 |
| WO | 02062894 | | 8/2002 |
| WO | 02064354 | | 8/2002 |
| WO | 03016030 | | 2/2003 |
| WO | 03102737 | | 12/2003 |
| WO | 03106143 | | 12/2003 |
| WO | 03106573 | | 12/2003 |
| WO | 03106600 | | 12/2003 |
| WO | 2004011044 | | 2/2004 |
| WO | 2004037902 | | 5/2004 |
| WO | 2004048463 | | 6/2004 |
| WO | 2004050350 | | 6/2004 |
| WO | 2004063295 | | 7/2004 |
| WO | 2004076578 | | 9/2004 |
| WO | 2004091841 | | 10/2004 |
| WO | 2004092048 | | 10/2004 |
| WO | 2005028577 | | 3/2005 |
| WO | 2005073329 | | 8/2005 |
| WO | 2005080066 | | 9/2005 |
| WO | 2006004765 | | 1/2006 |
| WO | 2006055038 | | 5/2006 |
| WO | 2006074921 | | 7/2006 |
| WO | WO 2006074921 | A1 * | 7/2006 |

OTHER PUBLICATIONS

Machine Translation of WO 2006074921 A1, accessed from the EPO website.*
International Search Report and Written Opinion regarding PCT/IB2007/054909 dated May 8, 2008.
Non-final Office Action, U.S. Appl. No. 11/617,417 (Mar. 9, 2009).
U.S. Appl. No. 11/617,417, filed Dec. 28, 2006.
U.S. Appl. No. 11/777,116, filed Jul. 12, 2007.
U.S. Appl. No. 11/617,405, filed Dec. 28, 2006.
U.S. Appl. No. 11/777,124, filed Jul. 12, 2007.
U.S. Appl. No. 11/646,816, filed Dec. 28, 2006.
U.S. Appl. No. 11/647,534, filed Dec. 28, 2006.
U.S. Appl. No. 11/617,473, filed Dec. 28, 2006.
U.S. Appl. No. 11/617,523, filed Dec. 28, 2006.
U.S. Appl. No. 11/965,435, filed Dec. 27, 2006.
Non-final Office Action, U.S. Appl. No. 11/617,405 (Feb. 3, 2009).
Birla, M., et al. "Continuous Dyeing of Cotton Using Ultrasound" AATCC Book of Papers, IC&E, 1996, pp. 309-322.
Mathur, M. R., et al. "Energy Conservation in Wet Processing: Development of Low Energy Dyeing Machine." Colourage Annual. 2004. pp. 93-99.
"Ultrasonics Sound Technology for Textiles and Nonwovens" Express Textile, Issue Dated Aug. 21, 2003, 5 pages.
Vajnhandl, S., et al. "Ultrasound in Textile Dyeing and the Decolouration/Mineralization of Textile Dyes" Dyes and Pigments. (2005), 65, pp. 89-101.
Office Action regarding U.S. Appl. No. 11/617,523, dated May 29, 2008.
Office Action regarding U.S. Appl. No. 11/647,534, dated May 30, 2008.
Office Action regarding U.S. Appl. No. 11/646,816, dated May 30, 2008.
Non-final Office Action regarding U.S. Appl. No. 11/617,473, dated Jun. 2, 2009.
International Search Report and Written Opinion from PCT/IB2007/054903 dated Apr. 17, 2008.
Non-final Office Action regarding U.S. Appl. No. 11/647,534, dated Feb. 11, 2009.
Final office action regarding U.S. Appl. No. 11/617,523, dated Nov. 17, 2008.
Final office action regarding U.S. Appl. No. 11/647,534, dated Dec. 4, 2008.
Non-final office action regarding U.S. Appl. No. 11/646,816, dated Dec. 15, 2008.
U.S. Appl. No. 11/530,183, filed Sep. 8, 2006, Robert Allen Janssen.
Non-final Office Action, U.S. Appl. No. 11/777,124 (Apr. 20, 2009).
International Search Report and Written Opinion regarding PCT/IB2007/054890, dated Apr. 18, 2008.
International Search Report and Written Opinion regarding PCT/IB2007/054897, dated Apr. 16, 2008.
International Search Report and Written Opinion regarding PCT/IB2007/054889, dated Apr. 16, 2008.
International Search Report and Written Opinion regarding PCT/IB2007/054905 dated May 6, 2008.
Final Office action regarding U.S. Appl. No. 11/617,417, dated Sep. 22, 2009.
International Search Report and Written Opinion regarding PCT/IB2008/055396, dated Jul. 29, 2009.
Cohen, "The Importance of Viscosity in the Web Coating Process," Web Coating Blog, pp. 1-4 (Mar. 28, 2006).
Final Office Action, U.S. Appl. No. 11/617,405 (Jul. 31, 2009).
Non-Final Office Action Regarding U.S. Appl. No. 11/646,816, dated Jun. 26, 2009.
Non-final office action regarding U.S. Appl. No. 11/777,116, dated Sep. 28, 2009.
Non-final Office action regarding U.S. Appl. No. 11/530,198, dated Nov. 18, 2009.
Final Office action regarding U.S. Appl. No. 11/646,816, dated Jan. 11, 2010.
Non-final Office action regarding U.S. Appl. No. 11/965,435, dated Mar. 11, 2010.

* cited by examiner

PROCESS FOR DYEING A TEXTILE WEB

CROSS REFERENCE TO RELATED APPLICATION

This patent application is a continuation-in-part patent application of U.S. patent application Ser. No. 11/617,473 filed on Dec. 28, 2006.

FIELD OF INVENTION

This invention relates generally to processes for dyeing textile webs, and more particularly to a process for dyeing a textile web in which both ultrasonic energy and microwave energy is used to facilitate the dyeing process.

BACKGROUND

The dyeing of textile webs is commonly achieved in one of two manners, one being immersing the textile web into a bath of dye solution so that the dye soaks into the textile web and the second being applying dye to (e.g., by spraying or coating) one or both faces of the textile web. Immersion (also commonly referred to as a dip-coating process) of the textile web requires a substantial amount of dye solution to be used to saturate the textile web. In addition, following saturation the textile web must be washed to remove a substantial amount of unbound dye from the web. While dip-coating results in good penetration of the dye throughout the entire textile web, it presents a relatively inefficient use of the dye solution and requires considerable post-processing of the web.

Dye may instead be applied (such as by spraying or coating) to one or both faces of the textile web by any number of application techniques including, without limitation, ink jet systems, spray systems, gravure roll, slot die, rod coater, rotary screen curtain coater, air knife, brush and the like. Following the application of dye to the web, the web is often heated and/or steamed to promote binding of the dye to the textile web. The textile web is then washed, such as in a bath of water or other cleaning solution, to remove unbound and excess dye from the web.

Applying dye to the textile web in this manner (e.g., as opposed to dip-coating) requires considerably less dye to be initially applied to the web, and thus reduces the time spent heating/steaming the web to facilitate binding of the dye to the web, and also reduces the amount of unbound dye that needs to be subsequently washed from the web. Such dyeing operations where the dye is applied to only one face of the textile generally use less dye, but run the associated risk that dye does not adequately penetrate into and through the web to the opposite face to provide even or uniform coloring of the web. While dyeing both faces of the textile web somewhat reduces this risk it also requires additional dye to be used, resulting in more unbound dye that must be subsequently removed from the web.

Once the dye is applied to the web, it is also common to subject the dyed web to a drying and curing process, such as where the web is placed in an oven at a suitable temperature to dry the dye to thereby facilitate binding of the dye to the web. Where webs are dyed in a continuous, or line feed process, such a drying process often takes a relatively considerable amount of time compared to the desired speed at which the web is to be moved.

There is a need, therefore, for a dyeing process that reduces the amount of dye that needs to be used in dyeing a textile web and facilitates improved penetration of the dye into and through the web and subsequent binding of the dye to the web.

SUMMARY

In one embodiment, a process for dyeing a textile web having a first face and a second face opposite the first face generally comprises applying dye to the textile web and then moving the web in an open configuration thereof over a contact surface of an ultrasonic vibration system with the textile web in direct contact with the contact surface of the ultrasonic vibration system. The ultrasonic vibration system is operated to impart ultrasonic energy to the textile web to facilitate the distribution of dye throughout the web. The web is then moved further in its open configuration through a microwave application chamber of a microwave system and the microwave system is operated to impart microwave energy to the web in the microwave application chamber to facilitate binding of the dye to the web.

In another embodiment, a process for dyeing a textile web having a first face, a second face opposite the first face and a thickness from the first face to the second face generally comprises applying dye to the textile web throughout the thickness thereof. The web is then moved in an open configuration thereof through a microwave application chamber of a microwave system and the microwave system is operated to impart microwave energy to the web in the microwave application chamber to facilitate binding of the dye in the web.

In another embodiment, a process for dyeing a textile web having a first face and a second face opposite the first face generally comprises applying dye having a dielectric loss factor at 900 MHz and 22 degrees Celsius of at least about 5 and a dielectric loss factor at 2,450 MHz and 22 degrees Celsius of at least about 10 to the textile web and then moving the web in an open configuration thereof over a contact surface of an ultrasonic vibration system with the textile web in direct contact with the contact surface of the ultrasonic vibration system. The ultrasonic vibration system is operated to impart ultrasonic energy to the textile web to facilitate the distribution of dye throughout the web. The web is then moved further in its open configuration through a microwave application chamber of a microwave system and the microwave system is operated to impart microwave energy to the web in the microwave application chamber to facilitate binding of the dye to the web.

In another embodiment, a process for dyeing a textile web having a first face, a second face opposite the first face and a thickness from the first face to the second face generally comprises applying dye having a dielectric loss factor at 900 MHz and 22 degrees Celsius of at least about 5 and a dielectric loss factor at 2,450 MHz and 22 degrees Celsius of at least about 10 to the textile web throughout the thickness thereof. The web is then moved in an open configuration thereof through a microwave application chamber of a microwave system and the microwave system is operated to impart microwave energy to the web in the microwave application chamber to facilitate binding of the dye in the web.

BRIEF DESCRIPTION OF THE DRAWINGS

Corresponding reference characters indicate corresponding parts throughout the drawings.

DETAILED DESCRIPTION

Figure 1:
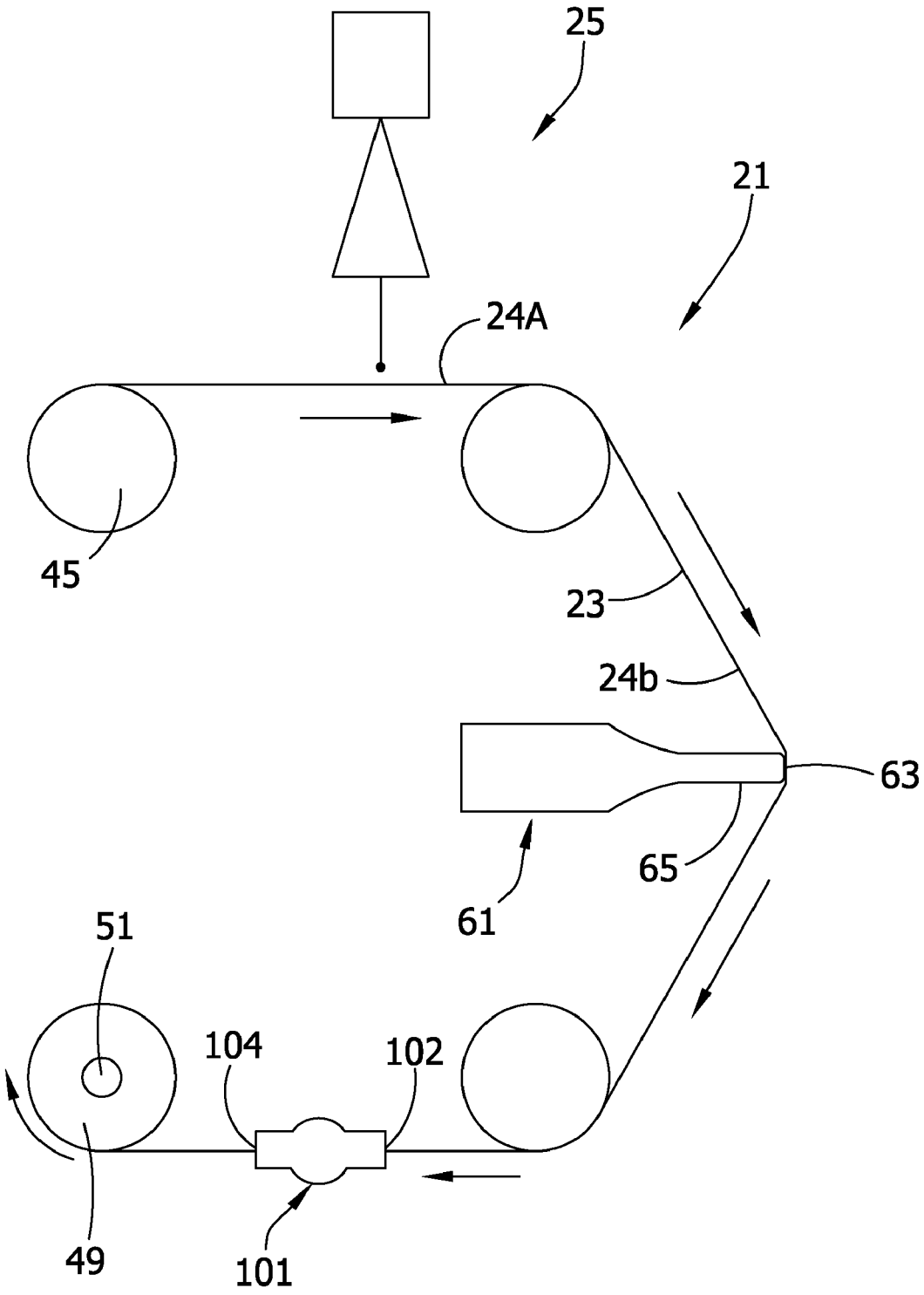
FIG. 1 is a schematic of one embodiment of apparatus for dyeing a textile web according to one embodiment of a process for dyeing a textile web.

With reference now to the drawings and in particular to FIG. 1, one embodiment of apparatus for use in dyeing a textile web 23 is generally designated 21. In one suitable embodiment, the textile web 23 to be processed by the apparatus 21 is suitably a woven web, but may also be a non-woven web, including without limitation bonded-carded webs, spunbond webs and meltblown webs, polyesters, polyolefins, cotton, nylon, silks, hydroknit, coform, nanofiber, fluff batting, foam, elastomerics, rubber, film laminates, combinations of these materials or other suitable materials. The textile web 23 may be a single web layer or a multilayer laminate in which one or more layers of the laminate are suitable for being dyed.

The term "spunbond" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10) larger than 7 microns, more particularly, between about 10 and 20 microns.

The term "meltblown" refers to fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin et al. Meltblown fibers are microfibers which may be continuous or discontinuous, are generally smaller than 10 microns in average diameter, and are generally tacky when deposited onto a collecting surface.

Laminates of spunbond and meltblown fibers may be made, for example, by sequentially depositing onto a moving forming belt first a spunbond web layer, then a meltblown web layer and last another spunbond web layer and then bonding the layers together. Alternatively, the web layers may be made individually, collected in rolls, and combined in a separate bonding step. Such laminates usually have a basis weight of from about 0.1 to 12 osy (6 to 400 gsm), or more particularly from about 0.75 to about 3 osy.

More suitably, the textile web 23 is sufficiently open or porous so that dye applied to the web may migrate throughout the thickness of the web. The "porosity" of the textile web 23 is a measurement of the void space within the textile and is measured for a particular web specimen in the following manner. For a given length (in centimeters) and width (in centimeters) of a web specimen (e.g., over which the web is generally homogeneous and, as such, has a uniform specific gravity), the specimen is weighed (in grams) by a suitable balance and the thickness (in centimeters) is measured using a suitable device, such as a VIR Electronic Thickness Tester, Model Number 89-1-AB commercially available from Thwing-Albert Instrument Company of Philadelphia, Pa., U.S.A. A total volume (in cubic centimeters) of the web specimen is determined as length×width×thickness. A material volume (in cubic centimeters) of the web specimen (i.e., the volume taken up just by the material in the web specimen) is determined as the weight of the web specimen divided by the specific gravity (in grams/cubic centimeter) of the material from which the web is constructed. The porosity (in percent) of the web specimen is then determined as ((total volume−material volume)/total volume)×100.

In particularly suitable embodiments, the textile web 23 has a porosity of at least about 10 percent, and more suitably at least about 20 percent. In other embodiments the porosity as determined by the Porosity Test may be at least about 50 and in others the porosity may be at least about 75. More suitably, the porosity is in the range of about 10 percent to about 90 percent, and more suitably in the range of about 20 percent to about 90 percent.

Some non-limiting examples of suitable textile webs include a cotton fabric commercially available from Springs Global of Ft. Mill, S.C., U.S.A. as Spring Global Muslin CPG W/O-SKU 743006050371 (having a basis weight of about 105 grams/square meter (gsm)); a polyester fabric commercially available from John Boyle & Company of Statesville, N.C., U.S.A. as Main Street Fabrics-European Fashion PP-SKU 1713874 (having a basis weight of about 61 gsm); and a spunbond non-woven web commercially available from Pegas Nonwovens S.R.O. of Znojmo, Czech Republic as 23 gsm Pegas PP Liner necked to a basis weight of about 42 gsm. As a contrasting example, one unsuitable web material is paper, such as ink jet paper, and in particular ink jet paper commercially available as RSA Premium Inkjet Paper IJC2436300-24 pound (having a basis weight of about 92.4 gsm). The following table provides the porosity for each of these web materials, as determined by using the above measurement technique on four 7.5 cm×7.5 cm web specimens for each material and averaging the data.

| | weight (grams) | thickness (cm) | specific gravity (g/cc) | total volume (cc) | material volume (cc) | pore volume (cc) | porosity (percent) |
|---|---|---|---|---|---|---|---|
| Cotton fabric | 0.59 | 0.0288 | 1.490 | 1.62 | 0.39 | 1.23 | 76 |
| Polyester fabric | 0.35 | 0.0140 | 0.930 | 0.79 | 0.38 | 0.41 | 52 |
| Spunbond non-woven | 0.25 | 0.0350 | 0.900 | 1.97 | 0.28 | 1.70 | 86 |
| Inkjet paper | 0.52 | 0.0098 | 0.929 | 0.55 | 0.55 | 0.00 | 0 |

The dyeing apparatus 21 suitably comprises a dye applicating device, schematically and generally indicated at 25, operable to apply dye to at least one of the faces 24*a*, 24*b* of the textile web 23. For example, in the embodiment illustrated in FIG. 1, the dye applicating device is particularly operable to apply dye to only one face 24*a* of the textile web. It is understood, however, that the applicating device may be operable to apply dye only to the opposite face 24*b* of the textile web 23, or to both faces of the web. It is also contemplated that more than one applicating device may be used (e.g., one corresponding to each face 24*a*, 24*b* of the textile web 23) to apply ink to both faces of the textile web either concurrently or sequentially.

The term "dye" as used herein refers to a substance that imparts more or less permanent color to other materials, such as to the textile web 23. Suitable dyes include, without limitation, inks, lakes (also often referred to as color lakes), dyestuffs (for example but not limited to acid dyes, azoic dyes, basic dyes, direct dyes, disperse dyes, food, drug and cosmetic dyes, ingrain dyes, leather dyes, mordant dyes, natural dyes, reactive dyes, solvent dyes sulfur dyes and vat dyes), pigments (organic and inorganic) and other colorants (for example but not limited to fluorescent brighteners, developers, oxidation bases). The dye suitably has a viscosity in the range of about 2 to about 100 centipoises, more suitably in the range of about 2 to about 20 centipoises, and even more suitably in the range of about 2 to about 10 centipoises to facilitate flow of the dye into and throughout the web.

In a particularly suitable embodiment, the dye is of a composition that provides an enhanced absorption of microwave energy, such as by having a relatively high dielectric loss factor. As used herein, the "dielectric loss factor" is a measure of the receptivity of a material to high-frequency energy. The measure value of $\epsilon'$ is most often referred to as the dielectric constant, while the measured value of $\epsilon''$ is denoted as the dielectric loss factor. These values can be measured directly using the processing conditions provided by testing method ASTM D2520 and a Network Analyzer with a low power, external electric field (i.e., 0 dBm to +5 dBm) typically over a frequency range of 300 KHz to 3 GHz, although Network Analyzers to 20 GHz are readily available. Most commonly, dielectric loss factor is measured at a frequency of either 900 MHz or 2,450 MHz (and at room temperature, such as about 22 degrees Celsius). For example, a suitable measuring system can include an HP8720D Dielectric Probe, and a model HP8714C Network Analyzer, both available from Agilent Technologies of Brookfield, Wis., U.S.A. Additional suitable analyzers can include models HP8592B and 8593E, also available from Agilent Technologies of Brookfield, Wis., U.S.A. Substantially equivalent devices may also be employed. By definition $\epsilon''$ is always positive, and a value of less than zero is occasionally observed when $\epsilon''$ is near zero due to the measurement error of the analyzer.

In one particular embodiment, the dye may suitably have a dielectric loss factor at 900 MHz and 22 degrees Celsius of at least about 5, more suitably at least about 10, even more suitably at least about 11, and even more suitably at least 14. For comparison purposes, the dielectric loss factor of water under the same conditions is less than about 3.8. In another suitable embodiment, the dye has a dielectric loss factor at 2,450 MHz and 22 degrees Celsius of at least about 10, more suitably at least about 15, and even more suitably at least about 17. Water has a dielectric loss factor of about 9.6 or lower under these same conditions.

As an example, the dye may include additives or other materials to enhance the affinity of the dye to microwave energy. Examples of such additives and materials include, without limitation, various mixed valent oxides, such as magnetite, nickel oxide and the like; carbon, carbon black and graphite; sulfide semiconductors, such as $FeS_2$ and $CuFeS_2$; silicon carbide; various metal powders such as powders of aluminum, iron and the like; various hydrated salts and other salts, such as calcium chloride dihydrate; diatomaceous earth; aliphatic polyesters (e.g., polybutylene succinate and poly(butylene succinate-co-adipate), polymers and copolymers of polylactic acid and polyethylene glycols; various hygroscopic or water absorbing materials or more generally polymers or copolymers with many sites of —OH groups.

Examples of other suitable inorganic microwave absorbers include, without limitation, aluminum hydroxide, zinc oxide, barium titanate. Examples of other suitable organic microwave absorbers include, without limitation, polymers containing ester, aldehyde ketone, isocyanate, phenol, nitrile, carboxyl, vinylidene chloride, ethylene oxide, methylene oxide, epoxy, amine groups, polypyrroles, polyanilines, polyalkylthiophenes. Mixtures of the above are also suitable for use in the dye applied to be applied to the textile web. The selective additive or material may be ionic or dipolar, such that the applied energy field can activate the molecule.

Non-limiting examples of suitable dyes that have the desired dielectric loss factor are inks commercially available from Yuhan-Kimberly of South Korea under the following designations: 67581-11005579 NanoColorant Cyan 220 ml; 67582-11005580 NanoColorant Magenta 220 ml; 67583-11005581 NanoColorant Yellow 220 ml; 67584-11005582 NanoColorant Black 220 ml; 67587-11005585 NanoColorant Red 220 ml; 67588-11005586 NanoColorant Orange 220 ml; 67591-11005589 NanoColorant Gray 220 ml; 67626-11006045 NanoColorant Violet 220 ml.

The dye applicating device 25 according to one embodiment may comprise any suitable device used for applying dye to textile webs 23 other than by saturating the entire web (e.g., by immersing the textile web in a bath of dye solution to saturate the web), whether the dye is pre-metered (e.g., in which little or no excess dye is applied to the web upon initial application of the dye) or post-metered (i.e., an excess amount of dye is applied to the textile web and subsequently removed). It is understood that the dye itself may be applied to the textile web 23 or the dye may be used in a dye solution that is applied to the web.

Examples of suitable pre-metered dye applicating devices 25 include, without limitation, devices for carrying out the following known applicating techniques:

Slot die: The dye is metered through a slot in a printing head directly onto the textile web 23.

Direct gravure: The dye is in small cells in a gravure roll. The textile web 23 comes into direct contact with the gravure roll and the dye in the cells is transferred onto the textile web.

Offset gravure with reverse roll transfer: Similar to the direct gravure technique except the gravure roll transfers the coating material to a second roll. This second roll then comes into contact with the textile web 23 to transfer dye onto the textile web.

Curtain coating: This is a coating head with multiple slots in it. Dye is metered through these slots and drops a given distance down onto the textile web 23.

Slide (Cascade) coating: A technique similar to curtain coating except the multiple layers of dye come into direct contact with the textile web 23 upon exiting the coating head. There is no open gap between the coating head and the textile web 23.

Forward and reverse roll coating (also known as transfer roll coating): This consists of a stack of rolls which transfers the dye from one roll to the next for metering purposes. The final roll comes into contact with the textile web 23. The moving direction of the textile web 23 and the rotation of the final roll determine whether the process is a forward process or a reverse process.

Extrusion coating: This technique is similar to the slot die technique except that the dye is a solid at room temperature. The dye is heated to melting temperature in the print head and metered as a liquid through the slot directly onto the textile web 23. Upon cooling, the dye becomes a solid again.

Rotary screen: The dye is pumped into a roll which has a screen surface. A blade inside the roll forces the dye out through the screen for transfer onto the textile.

Spray nozzle application: The dye is forced through a spray nozzle directly onto the textile web 23. The desired amount (pre-metered) of dye can be applied, or the textile web 23 may be saturated by the spraying nozzle and then the excess dye can be squeezed out (post-metered) by passing the textile web through a nip roller.

Flexographic printing: The dye is transferred onto a raised patterned surface of a roll. This patterned roll then contacts the textile web 23 to transfer the dye onto the textile.

Digital textile printing: The dye is loaded in an ink jet cartridge and jetted onto the textile web 23 as the textile web passes under the ink jet head.

Examples of suitable post-metering dye applicating devices for applying the dye to the textile web 23 include without limitation devices that operate according to the following known applicating techniques:

Rod coating: The dye is applied to the surface of the textile web 23 and excess dye is removed by a rod. A Mayer rod is the prevalent device for metering off the excess dye.

Air knife coating: The dye is applied to the surface of the textile web 23 and excess dye is removed by blowing it off using a stream of high pressure air.

Knife coating: The dye is applied to the surface of the textile web 23 and excess dye is removed by a head in the form of a knife.

Blade coating: The dye is applied to the surface of the textile web 23 and excess dye is removed by a head in the form of a flat blade.

Spin coating: The textile web 23 is rotated at high speed and excess dye applied to the rotating textile web spins off the surface of the web.

Fountain coating: The dye is applied to the textile web 23 by a flooded fountain head and excess material is removed by a blade.

Brush application: The dye is applied to the textile web 23 by a brush and excess material is regulated by the movement of the brush across the surface of the web.

Following the application of dye to the textile web 23, the textile web is suitably delivered to an ultrasonic vibration system, generally indicated at 61, having a contact surface 63 (FIG. 2) over which the dyed web 23 passes in contact with the vibration system such that the vibration system imparts ultrasonic energy to the web. In the illustrated embodiment, the ultrasonic vibration system 61 has a terminal end 65, at least a portion of which defines the contact surface 63 contacted by the textile web 23.

Figure 2:
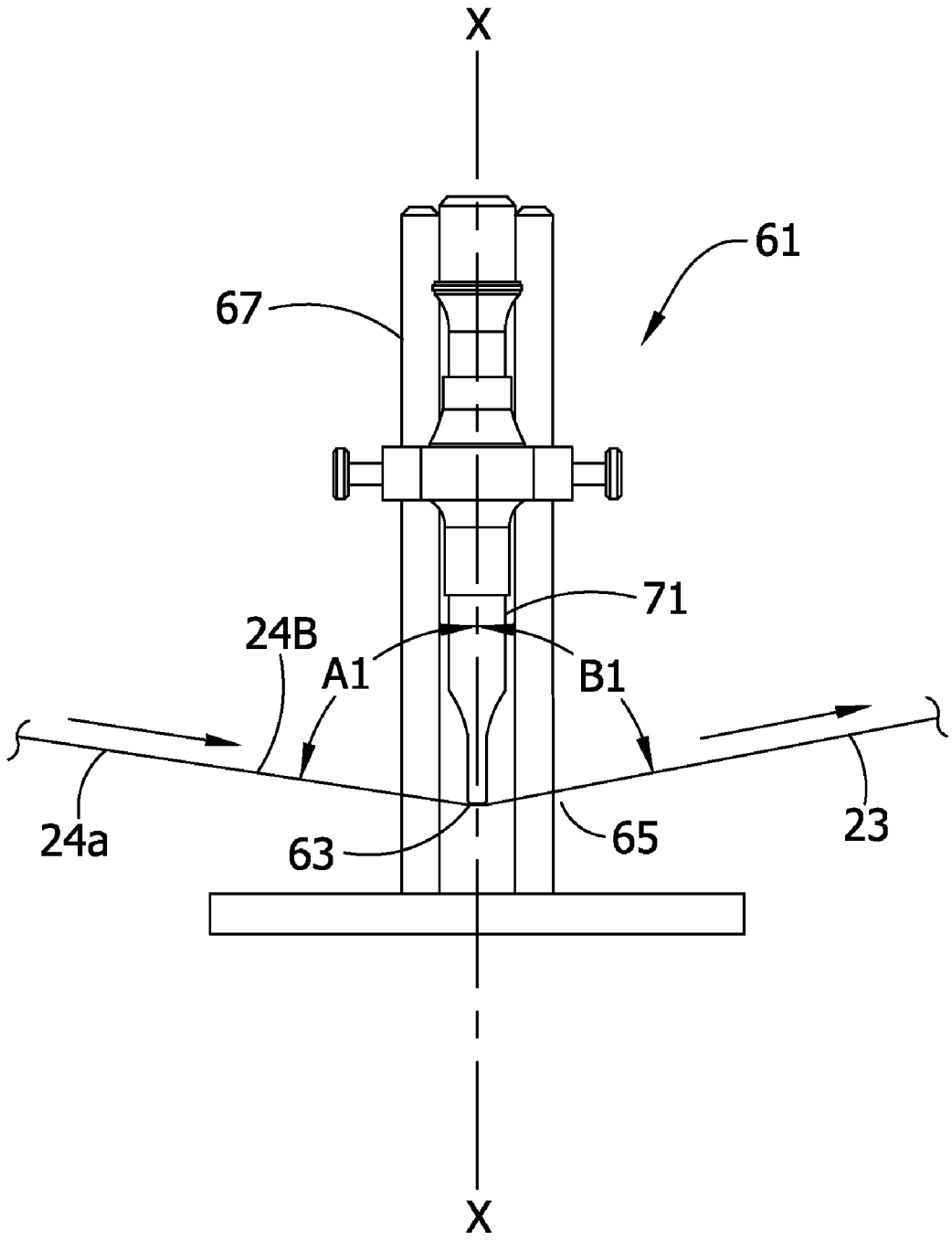
FIG. 2 is a side elevation of an ultrasonic vibration system and support frame of the apparatus of FIG. 1.

In one particularly suitable embodiment, the textile web 23 is suitably in the form of a generally continuous web, and more particularly a rolled web wherein the web is unrolled during processing and then rolled up following processing for transport to other post-processing stations. For example, as illustrated in FIGS. 1 and 2, the ultrasonic vibration system 61 may be suitably mounted on a support frame 67 (FIG. 2) intermediate an unwind roll 45 and a wind roll 49 (the unwind roll and wind roll also being mounted on suitable respective support frames (not shown)). It is understood, however, that the textile web 23 may alternatively be in the form of one or more discrete webs during treatment without departing from the scope of this invention. The dye applicating device 25 is located between the unwind roll 45 and the ultrasonic vibration system to apply dye to the one face 24*a* of the textile web before the web advances to the vibration system. It is understood, however, that dye may be applied to the textile web 23 other than immediately upstream of the ultrasonic vibration system, such as at a station that is entirely separate from that at which the web is ultrasonically treated, without departing from the scope of this invention.

The textile web 23 is suitably advanced (i.e., moved), such as by a suitable drive mechanism 51 (FIG. 1) at the wind roll 49, in a machine direction (indicated by the direction arrows in FIGS. 1 and 2) from the unwind roll past the dye applicating device 25 and the ultrasonic vibration system 61 to the wind roll. The term "machine direction" as used herein refers generally to the direction in which the textile web 23 is moved (e.g., longitudinally of the web in the illustrated embodiment) during processing. The term "cross-machine direction" is used herein to refer to the direction normal to the machine direction of the textile web 23 and generally in the plane of the web (e.g., widthwise of the web in the illustrated embodiment). With particular reference to FIG. 2, the textile web 23 suitably advances toward the contact surface 63 (e.g., at the terminal end 65 of the ultrasonic vibration system 61) at an approach angle A1 relative to a longitudinal axis X of the ultrasonic vibration system 61, and after passing over the contact surface the web further advances away from the contact surface at a departure angle B1 relative to the longitudinal axis X of the ultrasonic vibration system.

The approach angle A1 of the textile web 23, in one embodiment, is suitably in the range of about 1 to about 89 degrees, more suitably in the range of about 1 to about 45 degrees, and even more suitably in the range of about 10 to about 45 degrees. The departure angle B1 of the web 23 is suitably approximately equal to the approach angle A1 as illustrated in FIG. 2. However, it is understood that the departure angle B1 may be greater than or less than the approach angle A1 without departing from the scope of this invention.

In one particularly suitable embodiment, the ultrasonic vibration system 61 is adjustably mounted on the support frame 67 for movement relative to the support frame (e.g., vertically in the embodiment illustrated in FIG. 2) and the unwind and wind rolls 45, 49 to permit adjustment of the contact surface 63 of the ultrasonic vibration system relative to the web 23 to be treated. For example, the ultrasonic vibration system 61 is selectively positionable between a first position (not shown) at which the approach angle A1 and departure angle B1 of the web is substantially zero or at least relatively small, and a second position illustrated in FIGS. 1 and 2. In the first position of the vibration system 61, the contact surface 63 of the vibration system may but need not necessarily be in contact with the textile web 23.

In the second, or operating position of the ultrasonic vibration system 61, the terminal end 65 (and hence the contact surface 63) of the vibration system is substantially spaced from the first position and is in contact with the textile web 23. Movement of the vibration system 61 from its first position to its second position in this embodiment urges the web 23 to along with the contact surface 63 so as to form the approach and departure angles A1, B1 of the web.

Moving the ultrasonic vibration system 61 from its first position to its second position in this manner may also serve to tension, or increase the tension in, the textile web 23 at least along the segment of the web that lies against the contact surface 63 of the vibration system while the web is held between the unwind roll 45 and the wind roll 49. For example, in one embodiment the textile web 23 may be held in uniform tension along its width (i.e., its cross-machine direction dimension), at least at that segment of the web that is contacted by the contact surface 63 of the ultrasonic vibration system 61, in the range of about 0.025 pounds/inch of web width to about 3 pounds/inch of web width, and more suitably in the range of about 0.1 to about 1.25 pounds/inch of web width.

In one particularly suitable embodiment, the ultrasonic vibration system 61 is particularly located relative to the textile web 23 so that the contact surface 63 of the vibration system contacts the face 24*b* of the web opposite the face 24*a* to which the dye was initially applied. While in the illustrated embodiment the dye is applied to the one face 24*a* of the textile web while the ultrasonic vibration system 61 contacts the opposite face 24*b*, it is understood that the dye may instead be applied to the face 24*b* while the ultrasonic vibration system contacts the opposite face 24*a*.

Figure 3:
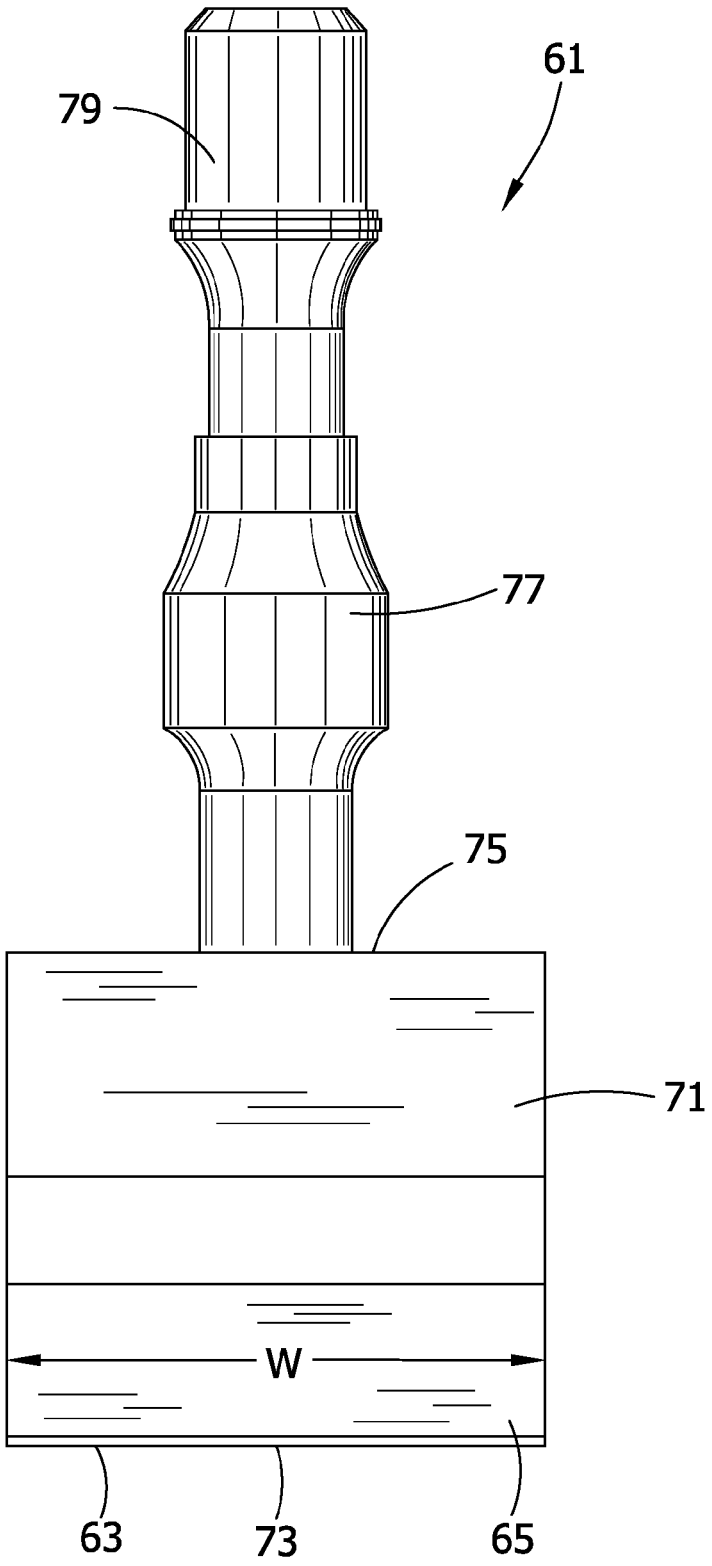
FIG. 3 is a front elevation of the ultrasonic vibration system of the apparatus of FIG. 1.

With particular reference now to FIG. 3, the ultrasonic vibration system 61 in one embodiment suitably comprises an ultrasonic horn, generally indicated at 71, having a terminal end 73 that in the illustrated embodiment defines the terminal end 65 of the vibration system, and more particularly defines the contact surface 63 of the vibration system. In particular, the ultrasonic horn 71 of FIG. 3 is suitably configured as what is referred to herein as an ultrasonic bar (also sometimes referred to as a blade horn) in which the terminal end 73 of the horn is generally elongate, e.g., along its width w. The ultrasonic horn 71 in one embodiment is suitably of unitary construction such that the contact surface 63 defined by the terminal end 73 of the horn is continuous across the entire width w of the horn.

Additionally, the terminal end 73 of the horn 71 is suitably configured so that the contact surface 63 defined by the terminal end of the ultrasonic horn is generally flat and rectangular. It is understood, however, that the horn 71 may be configured so that the contact surface 63 defined by the terminal end 73 of the horn is more rounded or other than flat without departing from the scope of this invention. The ultrasonic horn 71 is suitably oriented relative to the moving textile web 23 so that the terminal end 73 of the horn extends in the cross-machine direction across the width of the web. The width w of the horn 71, at least at its terminal end 73, is suitably sized approximately equal to and may even be greater than the width of the web.

Figure 4:
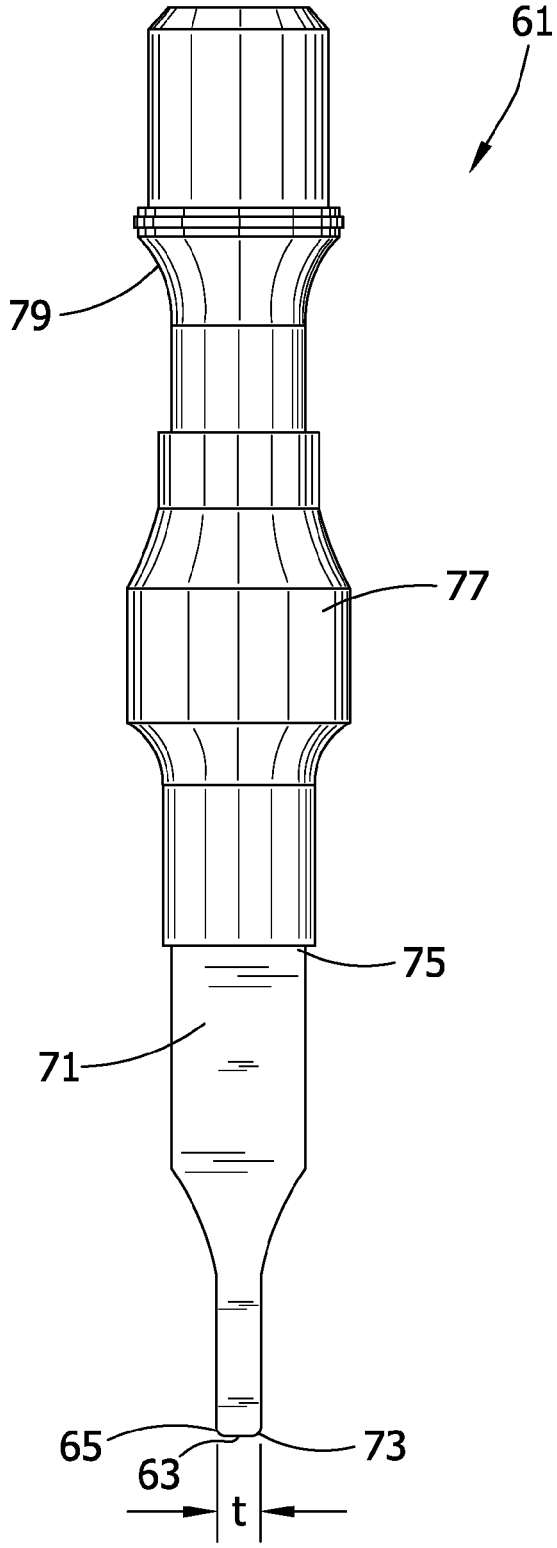
FIG. 4 is a side elevation thereof.

A thickness t (FIG. 4) of the ultrasonic horn 71 is suitably greater at a connection end 75 of the horn (i.e., the longitudinal end of the horn opposite the terminal end 73 thereof) than at the terminal end of the horn to facilitate increased vibratory displacement of the terminal end of the horn during ultrasonic vibration. As one example, the ultrasonic horn 71 of the illustrated embodiment of FIGS. 3 and 4 has a thickness t at its connection end 75 of approximately 1.5 inches (3.81 cm) while its thickness at the terminal end 73 is approximately 0.5 inches (1.27 cm). The illustrated horn 71 also has a width w of about 6.0 inches (15.24 cm) and a length (e.g., height in the illustrated embodiment) of about 5.5 inches (13.97 cm). The thickness t of the illustrated ultrasonic horn 71 tapers inward as the horn extends longitudinally toward the terminal end 73. It is understood, however, that the horn 71 may be configured other than as illustrated in FIGS. 3 and 4 and remain within the scope of this invention as long as the horn defines a contact surface 63 of the vibration system 61 suitable for contacting the textile web 23 to impart ultrasonic energy to the web.

The ultrasonic vibration system 61 of the illustrated embodiment is suitably in the form of what is commonly referred to as a stack, comprising the ultrasonic horn, a booster 77 coaxially aligned (e.g., longitudinally) with and connected at one end to the ultrasonic horn 71 at the connection end 75 of the horn, and a converter 79 (also sometimes referred to as a transducer) coaxially aligned with and connected to the opposite end of the booster. The converter 79 is in electrical communication with a power source or generator (not shown) to receive electrical energy from the power source and convert the electrical energy to high frequency mechanical vibration. For example, one suitable type of converter 79 relies on piezoelectric material to convert the electrical energy to mechanical vibration.

The booster 77 is configured to amplify (although it may instead be configured to reduce, if desired) the amplitude of the mechanical vibration imparted by the converter 79. The amplified vibration is then imparted to the ultrasonic horn 71. It is understood that the booster 77 may instead be omitted from the ultrasonic vibration system 61 without departing from the scope of this invention. Construction and operation of a suitable power source, converter 79 and booster 77 are known to those skilled in the art and need not be further described herein.

In one embodiment, the ultrasonic vibration system 61 is operable (e.g., by the power source) at a frequency in the range of about 15 kHz to about 100 kHz, more suitably in the range of about 15 kHz to about 60 kHz, and even more suitably in the range of about 20 kHz to about 40 kHz. The amplitude (e.g., displacement) of the horn 71, and more particularly the terminal end 73 thereof, upon ultrasonic vibration may be varied by adjusting the input power of the power source, with the amplitude generally increasing with increased input power. For example, in one suitable embodiment the input power is in the range of about 0.1 kW to about 4 kW, more suitably in the range of about 0.5 kW to about 2 kW and more suitably about 1 kW.

In operation according to one embodiment of a process for dyeing a textile web, a rolled textile web 23 is initially unwound from an unwind roll 45, e.g., by the wind roll 49 and drive mechanism 51, with the web passing the dye applicator 25 and the ultrasonic vibration system 61. The ultrasonic vibration system 61 is in its second position (as illustrated in FIGS. 1 and 2) with the terminal end 65 (and hence the contact surface 63) of the vibration system displaced along with the textile web to the desired approach and departure angles A1, B1 of the textile web. The textile web 23 may also be tensioned in the second position of the vibration system 61 and/or by further winding the wind roll 49, by back winding the unwind roll 45, by both, or by other suitable tensioning structure and/or techniques.

During processing between the unwind roll 45 and the wind roll 49, the textile web 23 is suitably configured in what is referred to herein as a generally open configuration as the web passes over the contact surface 63 of the ultrasonic vibration system 61. The term "open configuration" is intended to mean that the textile web 23 is generally flat or otherwise unfolded, ungathered and untwisted, at least at the segment of the web in contact with the contact surface 63 of the vibration system 61.

A feed rate of the web 23 (i.e., the rate at which the web moves in the machine direction over the contact surface 63 of the vibration system 61) and the width of the contact surface (i.e., the thickness t of the terminal end 73 of the horn 71 in the illustrated embodiment, or where the contact surface is not flat or planar, the total length of the contact surface from one side of the terminal end of the horn to the opposite side thereof) determine what is referred to herein as the dwell time of the web on the contact surface of the vibration system. It will be understood, then, that the term "dwell time" refers herein to the length of time that a segment of the textile web 23 is in contact with the contact surface 63 of the vibration system 61 as the web is drawn over the contact surface (e.g., the width of the contact surface divided by the feed rate of the web). In one suitable embodiment, the feed rate of the web 23 across the contact surface 63 of the vibration system 61 is in the range of about 0.5 feet/minute to about 2,000 feet/minute, more suitably in the range of about 1 feet/minute to about 100 feet/minute and even more suitably in the range of about 2 feet/minute to about 10 feet/minute. It is understood, however, that the feed rate may be other than as set forth above without departing from the scope of this invention.

In other embodiments, the dwell time is suitably in the range of about 0.1 second to about 60 seconds, more suitably in the range of about 1 second to about 10 seconds, and even more suitably in the range of about 2 seconds to about 5 seconds. It is understood, however, that the dwell time may be other than as set forth above depending for example on the material from which the web 23 is made, the dye composition, the frequency and vibratory amplitude of the horn 71 of the vibration system 61 and/or other factors, without departing from the scope of this invention.

As the textile web 23 passes the dye applicating device 25, dye is applied to the one face 24*a* of the web. The ultrasonic vibration system 61 is operated by the power source to ultrasonically vibrate the ultrasonic horn 71 as the opposite face 24*b* of the textile web 23 is drawn over the contact surface 63 of the vibration system. The horn 71 imparts ultrasonic energy to the segment of the textile web 23 that is in contact with the contact surface 63 defined by the terminal end 73 of the horn. Imparting ultrasonic energy to the opposite face 24*b* of the textile web 23 facilitates the migration of dye from the one face 24*a* of the web into and through the web to the opposite face 24*b* of the web.

It is understood, however, that the face 24*a* (i.e., the face on which the dye is applied) of the textile web 23 may oppose and contact the contact surface 63 of the vibration system 61 without departing from the scope of this invention. It is also contemplated that a second ultrasonic vibration system (not shown) may be used to apply ultrasonic energy to the face 24*a* of the web, either concurrently or sequentially with the first ultrasonic vibration system 61 applying ultrasonic energy to the opposite face 24*b* of the web.

With reference now back to FIG. 1, following ultrasonic treatment of the dyed textile web, the textile web is further advanced to, and through, a microwave system, generally indicated at 101 operable to direct high frequency, electromagnetic radiant energy, and more suitably microwave energy, to the dyed textile web 23 to facilitate expedited and enhanced binding of the dye to the web. In one particularly suitable embodiment, for example, the microwave system 101 may employ energy having a frequency in the range of about 0.01 MHz to about 5,800 MHz, and more suitably in the range of about 900 MHz to about 2,450 MHz. In one embodiment the frequency is more suitably about 900 MHz. In another embodiment the frequency is more suitably about 2,450 MHz.

Figure 5:
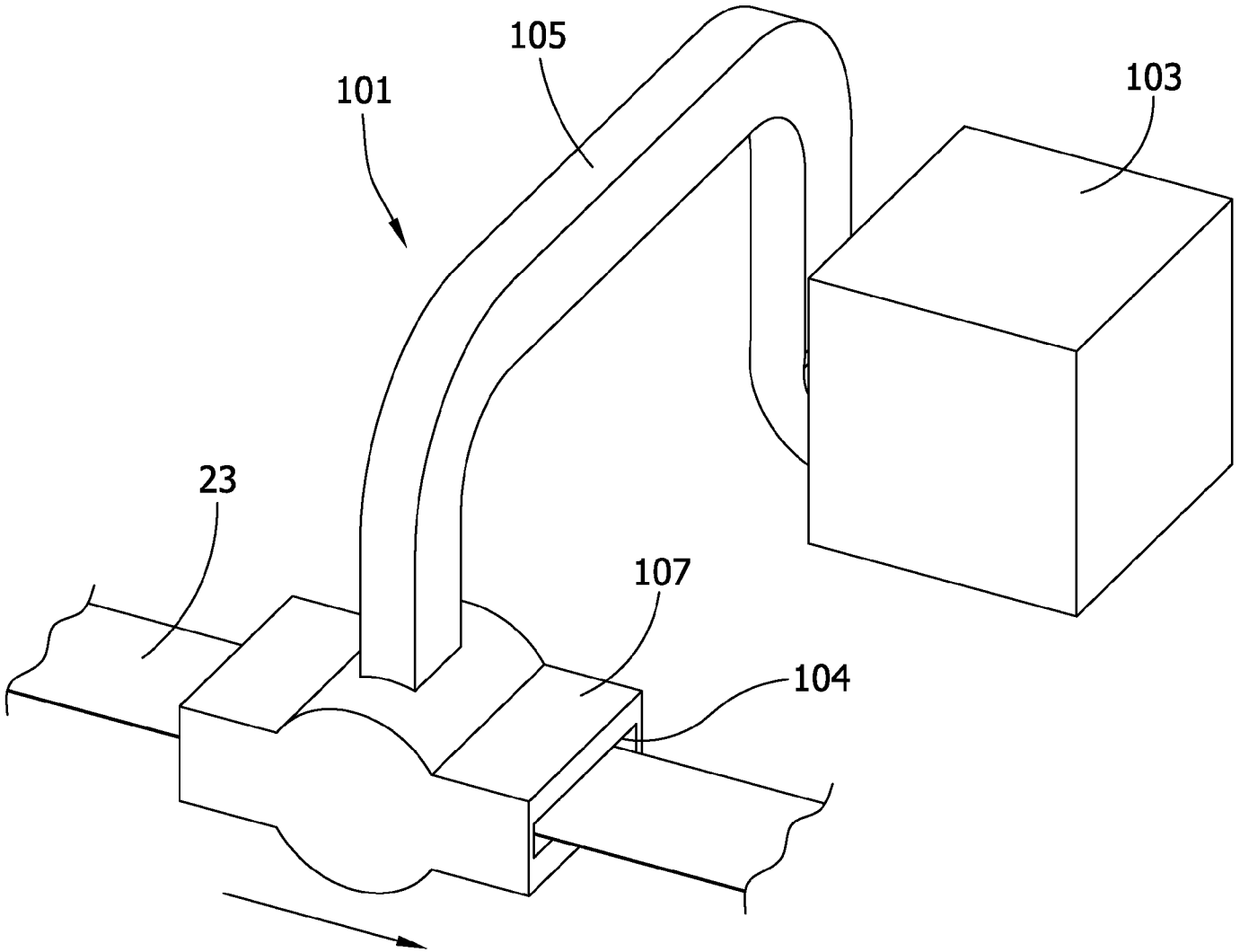
FIG. 5 is a perspective of one embodiment of a microwave system for use with the apparatus of FIG. 1.

The microwave system 101, with reference to FIG. 5 suitably comprises a microwave generator 103 operable to produce the desired amount of microwave energy, a wave-guide 105 and an application chamber 107 through which the textile web 23 passes while moving in the machine direction (indicated by the direction arrow in FIG. 5). For example, the input power of the microwave generator is suitably in the range of about 1,500 watts to about 6,000 watts. It is understood, however, that in other embodiments the power input may be substantially greater, such as about 75,000 watts or more, without departing from the scope of this invention.

Figure 6:
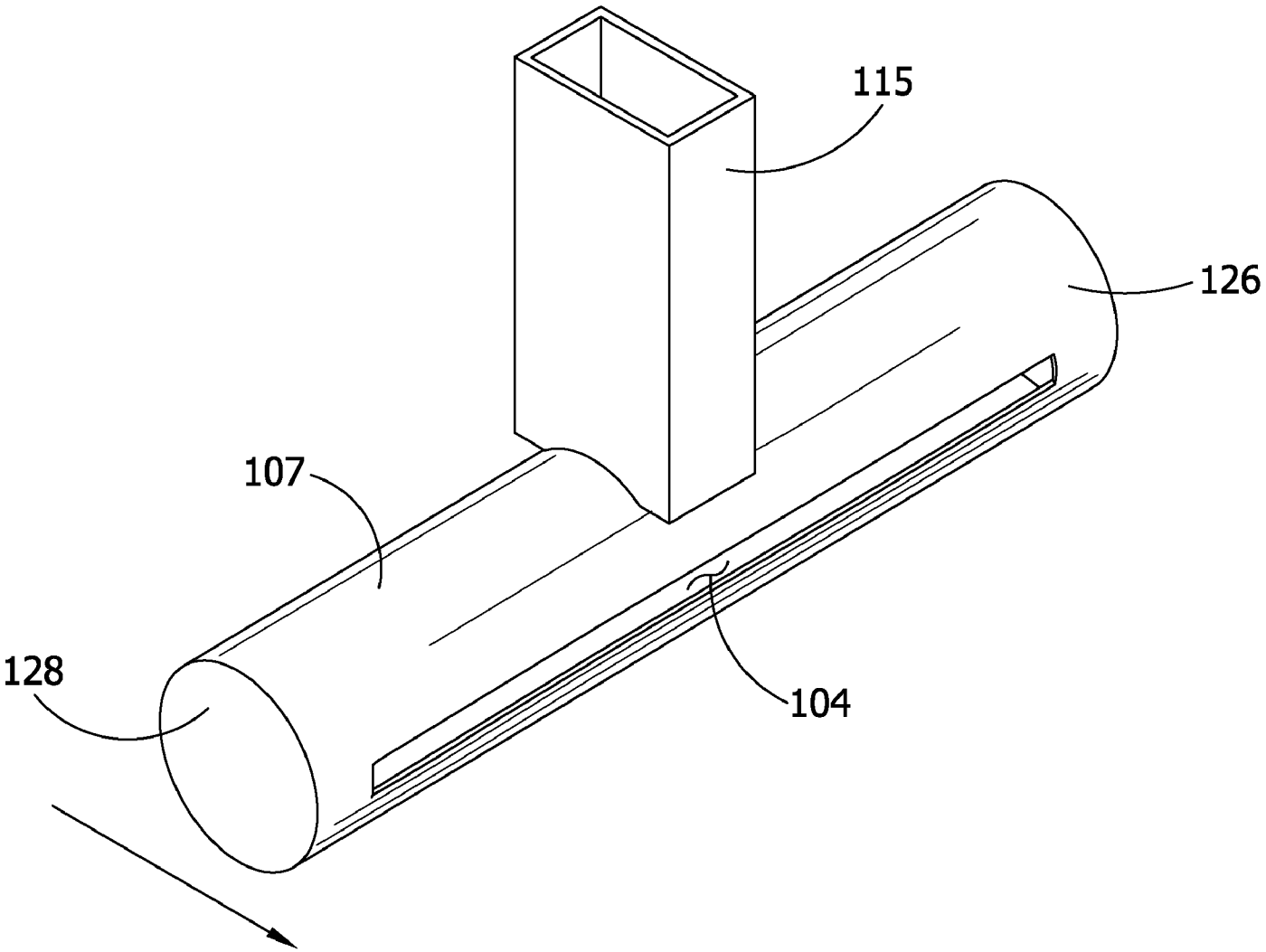
FIG. 6 is a perspective of a second embodiment of a microwave system for use with the apparatus of FIG. 1.

In a particular embodiment, illustrated in FIG. 6, the application chamber 107 comprises a housing 126 operatively connected to the wave-guide 105 and having end walls 128, an entrance opening (not shown in FIG. 6 but similar to an entrance opening 102 shown in FIG. 7) for receiving the textile web 23 into the application chamber, and an outlet opening 104 through which the textile web exits the application chamber for subsequent movement to the wind roll 49. The entrance and exit openings 102, 104 can be suitably sized and configured slightly larger than the textile web 23 so as to allow the textile web, in its open configuration, to pass through the entrance and exit while inhibiting an excessive leakage of energy from the application chamber. The wave-guide 105 and application chamber 107 may be constructed from suitable non-ferrous, electrically-conductive materials, such as aluminum, copper, brass, bronze, gold and silver, as well as combinations thereof.

The application chamber 107 in one particularly suitable embodiment is a tuned chamber within which the microwave energy can produce an operative standing wave. For example, the application chamber 107 may be configured to be a resonant chamber. Examples of suitable arrangements for a resonant application chamber 107 are described in U.S. Pat. No. 5,536,921 entitled SYSTEM FOR APPLYING MICROWAVE ENERGY IN SHEET-LIKE MATERIAL by Hedrick et al., issued Jul. 16, 1996; and in U.S. Pat. No. 5,916,203 entitled COMPOSITE MATERIAL WITH ELASTICIZED PORTIONS AND A METHOD OF MAKING THE SAME by Brandon et al, issued Jun. 29, 1999. The entire disclosures of these documents are incorporated herein by reference in a manner that is consistent herewith.

In another embodiment, the effectiveness of the application chamber 107 can be determined by measuring the power that is reflected back from the impedance load provided by the combination of the application chamber 107 and the target material (e.g. the textile web 23) in the application chamber. In a particular aspect, the application chamber 107 may be configured to provide a reflected power which is not more than a maximum of about 50% of the power that is delivered to the impedance load. The reflected power can alternatively be not more than about 20% of the delivered power, and can optionally be not more than about 10% of the delivered power. In other embodiments, however, the reflected power may be substantially zero. Alternatively, the reflected power may be about 1%, or less, of the delivered power, and can optionally be about 5%, or less, of the delivered power. If the reflected power is too high, inadequate levels of energy are being absorbed by the dyed textile web 23 and the power being directed into the dyed web is being inefficiently utilized.

The application chamber 107 may also be configured to provide a Q-factor of at least a minimum of about 200. The Q-factor can alternatively be at least about 5,000, and can optionally be at least about 10,000. In other embodiments, the Q-factor can up to about 20,000, or more. If the Q-factor is too low, inadequate electrical field strengths are provided to the dyed textile web. The Q-factor can be determined by the following formula (which may be found in the book entitled Industrial Microwave Heating by R. C. Metaxas and R. J. Meredith, published by Peter Peregrinus, Limited, located in London, England, copyright 1983, reprinted 1993):

$$Q\text{-factor}=f_o/\Delta f$$

where:

$f_o$=intended resonant frequency (typically the frequency produced by the high-frequency generator), and $\Delta f$=frequency separation between the half-power points.

In determining the Q-factor, the power absorbed by the dyed textile web 23 is deemed to be the power delivered into the application chamber 107 to the web, minus the reflected power returned from the application chamber. The peak-power is the power absorbed by the dyed textile web 23 when the power is provided at the intended resonant frequency, $f_o$. The half-power points are the frequencies at which the power absorbed by the dyed textile web 23 falls to one-half of the peak-power.

For example, a suitable measuring system can include an HP8720D Dielectric Probe, and a model HP8714C Network Analyzer, both available from Agilent Technologies, a business having offices located at Brookfield, Wis., U.S.A. Other suitable analyzers can include models HP8592B and 8593E, also available from Agilent Technologies of Brookfield, Wis., U.S.A. A suitable procedure for determining the Q-factor is described in the User's Manual dated 1998, part number 08712-90056. Substantially equivalent devices and procedures may also be employed.

In another aspect, the application chamber 107 may be configured for selective tuning to operatively "match" the load impedance produced by the presence of the target material (e.g. the dyed textile web 23) in the application chamber. The tuning of the application chamber 107 can, for example, be provided by any of the techniques that are useful for "tuning" microwave devices. Such techniques can include configuring the application chamber 107 to have a selectively variable geometry, changing the size and/or shape of a wave-guide aperture, employing adjustable impedance components (e.g. stub tuners), employing a split-shell movement of the application chamber, employing a variable frequency energy source that can be adjusted to change the frequency of the energy delivered to the application chamber, or employing like techniques, as well as employing combinations thereof. The variable geometry of the application chamber 107 can, for example, be provided by a selected moving of either or both of the end walls 128 to adjust the distance therebetween.

Figure 7:
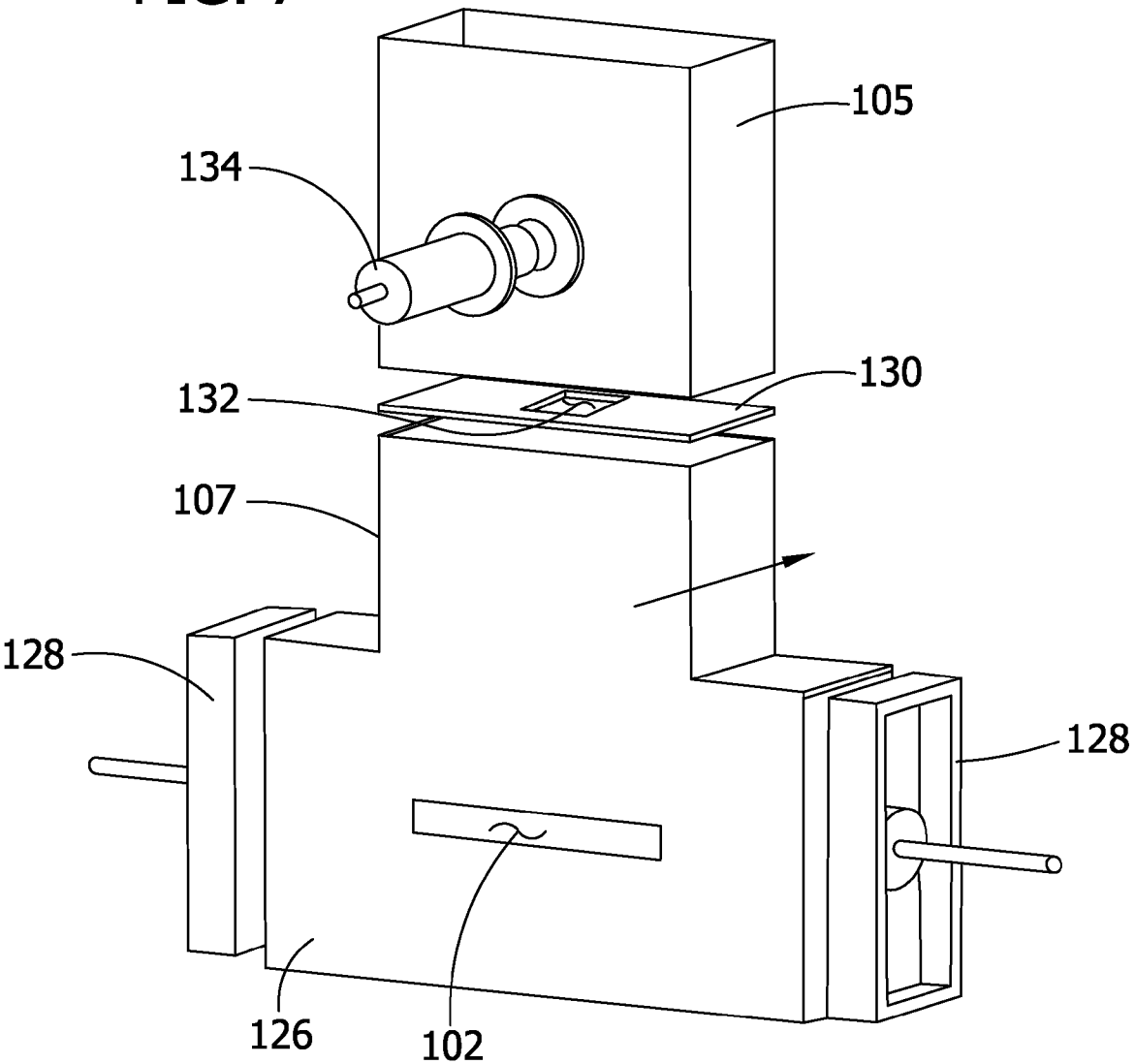
FIG. 7 is a perspective of a third embodiment of a microwave system for use with the apparatus of FIG. 1.

As representatively shown in FIGS. 7-10, the tuning feature may comprise an aperture plate 130 having a selectively sized aperture 132 or other opening. The aperture plate 130 may be positioned at or operatively proximate the location at which the wave-guide 105 joins the application chamber housing 126. The aperture 132 can be suitably configured and sized to adjust the waveform and/or wavelength of the energy being directed into the application chamber 107. Additionally, a stub tuner 134 may be operatively connected to the wave-guide 105. With reference to FIG. 7, the wave-guide 105 can direct the microwave energy into the chamber 107 at a location that is interposed between the two end walls 128. Either or both of the end walls 128 may be movable to provide selectively positionable end-caps, and either or both of the end walls may include a variable impedance device, such as provided by the representatively shown stub tuner 134. Alternatively, one or more stub tuners 134 may be positioned at other operative locations in the application chamber 107.

Figure 8:
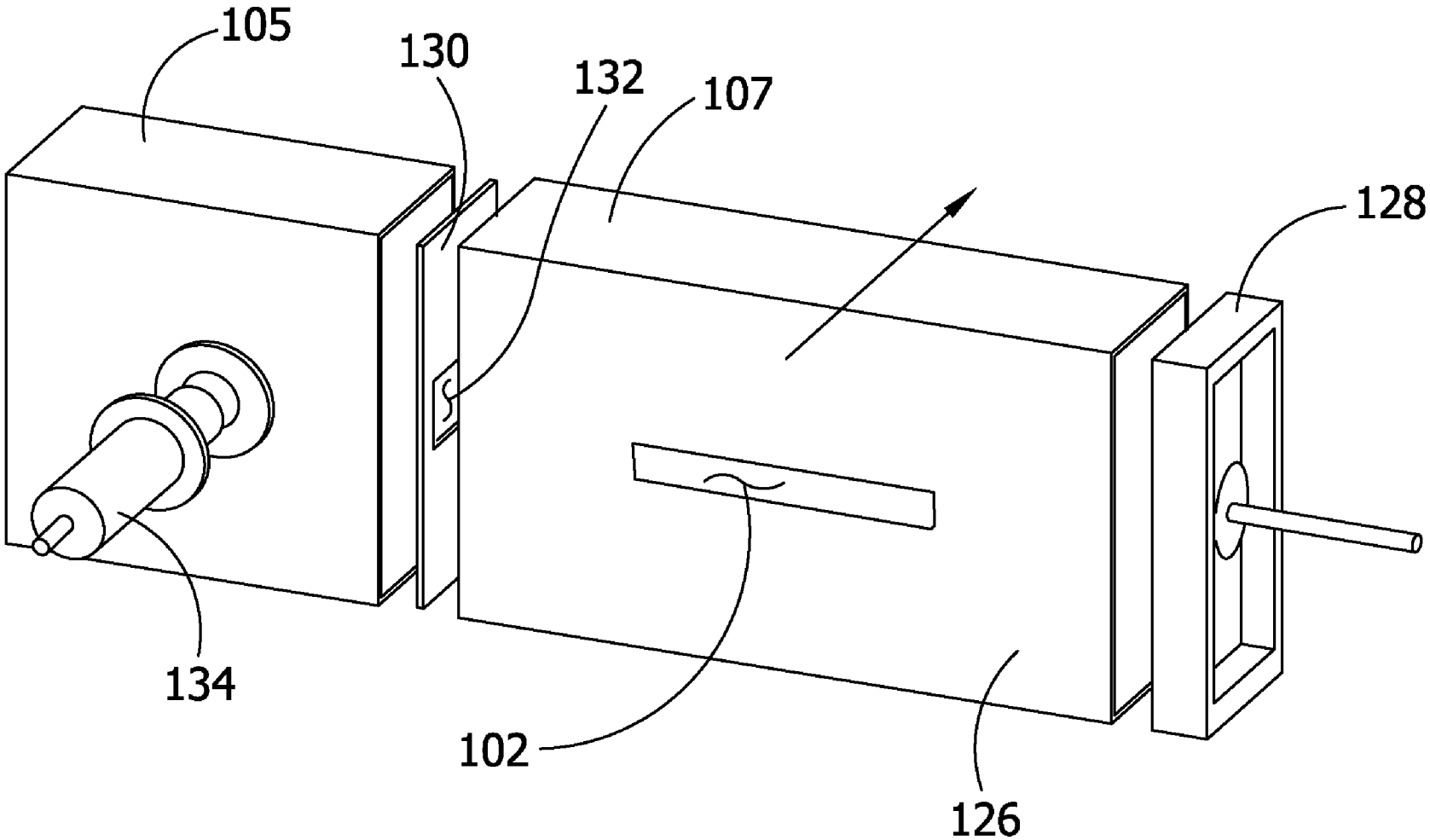
FIG. 8 is a perspective of a fourth embodiment of a microwave system for use with the apparatus of FIG. 1.

With reference to FIG. 8, the wave-guide 105 may be arranged to deliver the microwave energy into one end of the application chamber 107. Additionally, the end wall 128 at the opposite end of the chamber 107 may be selectively movable to adjust the distance between the aperture plate 130 and the end wall 128.

Figure 9:
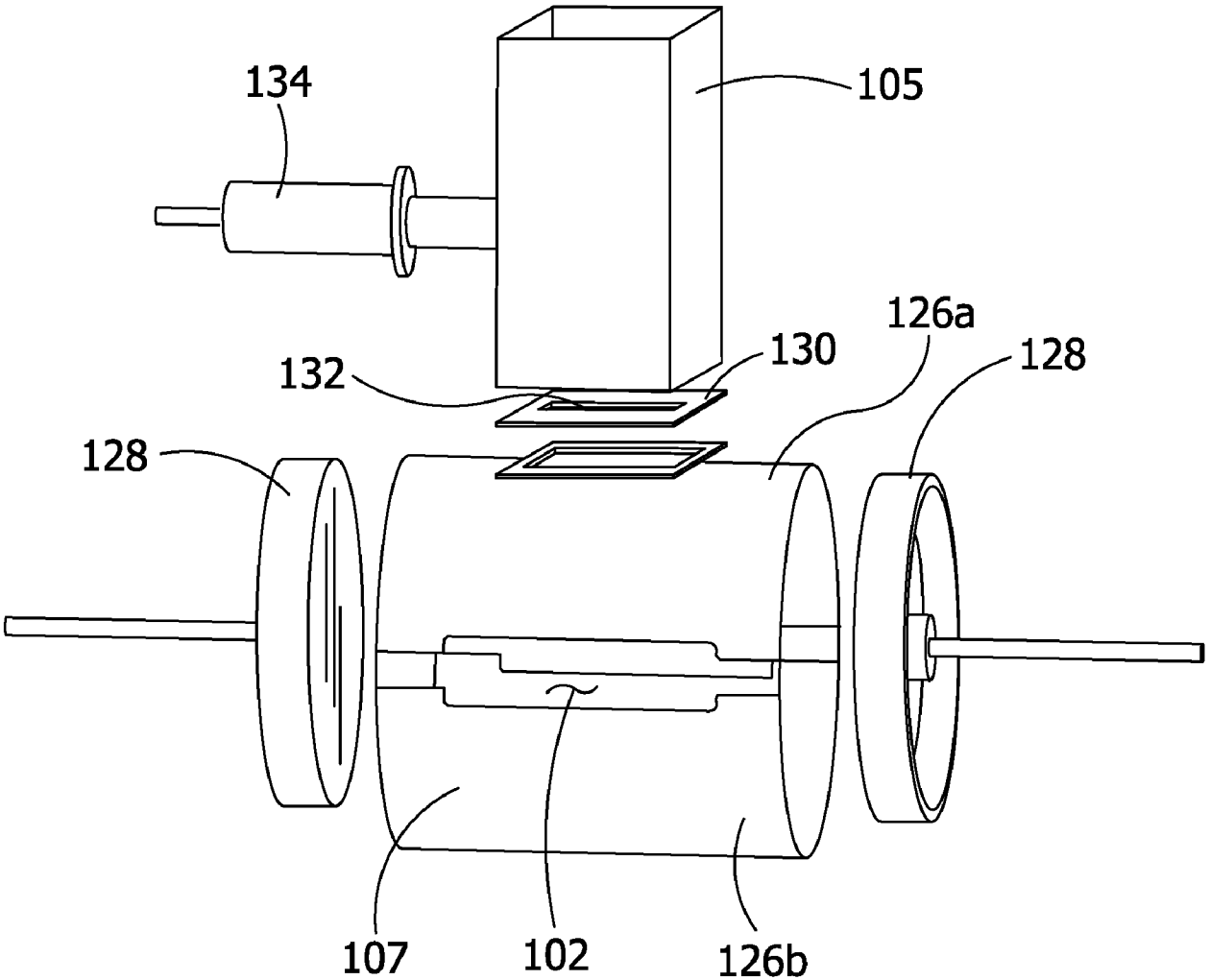
FIG. 9 is a perspective of a fifth embodiment of a microwave system for use with the apparatus of FIG. 1.

In the embodiment illustrated in FIG. 9, the application chamber 107 comprises a housing 126 that is non-rectilinear. In a further feature, the housing 126 may be divided to provide operatively movable split portions **126*a* and 126*b*. The chamber split-portions 126*a*, 126*b* can be selectively postionable to adjust the size and shape of the application chamber 107. As representatively shown, either or both of the end walls 128 are movable to provide selectively positionable end-caps, and either or both of the end walls may include a variable impedance device, such as provided by the representatively shown stub tuner 134. Alternatively, one or more stub tuners 134 may be positioned at other operative locations in the chamber 107**.

To tune the application chamber 107, the appointed tuning components are adjusted and varied in a conventional, iterative manner to maximize the power into the load (e.g. into the dyed textile web), and to minimize the reflected power. Accordingly, the tuning components can be systematically varied to maximize the power into the textile web 23 and minimize the reflected power. For example, the reflected power can be detected with a conventional power sensor, and can be displayed on a conventional power meter. The reflected power may, for example, be detected at the location of an isolator. The isolator is a conventional, commercially available device which is employed to protect a magnetron from reflected energy. Typically, the isolator is placed between the magnetron and the wave-guide 105. Suitable power sensors and power meters are available from commercial vendors. For example, a suitable power sensor can be provided by a HP E4412 CW power sensor which is available from Agilent Technologies of Brookfield, Wis., U.S.A. A suitable power meter can be provided by a HP E4419B power meter, also available from Agilent Technologies.

In the various configurations of the application chamber 107, a properly sized aperture plate 130 and a properly sized aperture 132 can help reduce the amount of variable tuning adjustments needed to accommodate a continuous product. The variable impedance device (e.g. stub tuner 134) can also help to reduce the amount of variable tuning adjustments needed to accommodate the processing of a continuous web 23. The variable-position end walls 128 or end caps can allow for easier adjustments to accommodate a varying load. The split-housing 126*a*, 126*b* (e.g., as illustrated in FIG. 9) configuration of the application chamber 107 can help accommodate a web 23 having a varying thickness.

Figure 10:
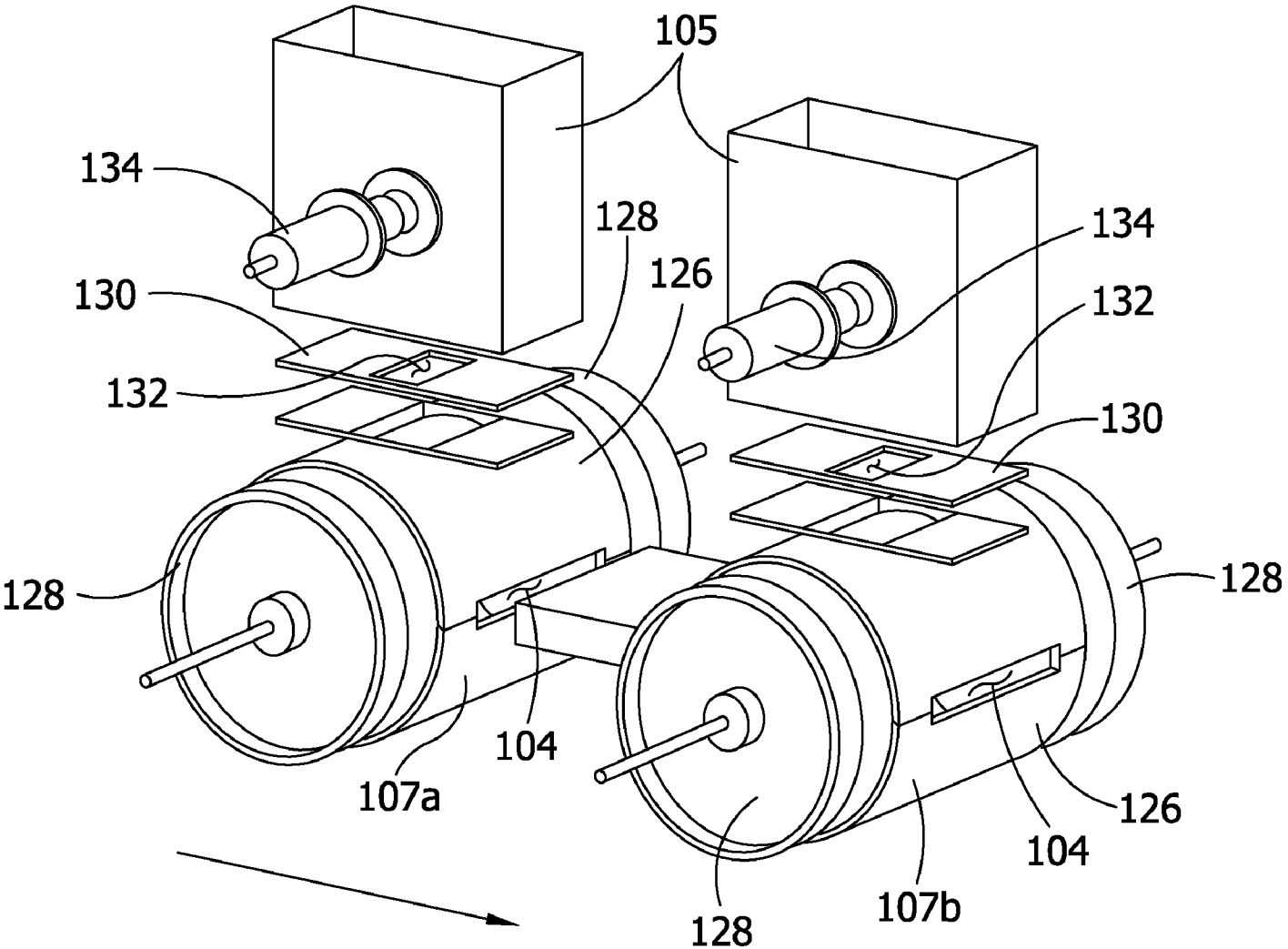
FIG. 10 is a perspective of a sixth embodiment of a microwave system for use with the apparatus of FIG. 1.

In another embodiment, illustrated in FIG. 10, the microwave system 101 may comprise two or more application chamber 107 (e.g. 107*a*+107*b*+ . . . ). The plurality of activation chambers 107 can, for example, be arranged in the representatively shown serial array.

As one example of the size of the application chamber 107, throughout the various embodiments the chamber may suitably have a machine-directional (indicated by the direction arrow in the various embodiments) length (e.g., from the entrance 102 to the exit 104, along which the web is exposed to the microwave energy in the chamber) of at least about 4 cm. In other aspects, the chamber 107 length can be up to a maximum of about 800 cm, or more. The chamber 107 length can alternatively be up to about 400 cm, and can optionally be up to about 200 cm. As more particular examples, the chamber 107 length is suitably about 4.4 cm. for an operating frequency of about 5,800 MHz applicator, about 8.9 cm. for an operating frequency of about 2,450 MHz. and about 25 cm. for an operating frequency of about 915 MHz for tuned circular cavities. Such lengths may be much longer for multimode microwave systems.

Where the microwave system 101 employs two or more application chambers 107 arranged in series, the total sum of the machine-directional lengths provided by the plurality of chambers may be at least about 10 cm and proportionally longer for lower frequencies. For example, in other aspects the total of the chamber 107 lengths can be up to a maximum of about 3000 cm, or more. The total of the chamber 107 lengths can alternatively be up to about 2000 cm, and can optionally be up to about 1000 cm.

The total residence time within the application chamber 107 or chambers can provide a distinctively efficient dwell time. The term "dwell time" in reference to the microwave system 101 refers to the amount of time that a particular portion of the dyed textile web 23 spends within the application chamber 107, e.g., in moving from the entrance opening 102 to the exit opening 104 of the chamber. In a particular aspect, the dwell time is suitably at least about 0.0002 sec. The dwell time can alternatively be at least about 0.005 sec, and can optionally be at least about 0.01 sec. In other embodiments the dwell time can be up to a maximum of about 3 sec, more suitably up to about 2 sec, and optionally up to about 1.5 sec.

In operation, after the dyed textile web 23 is moved past the ultrasonic vibration system 61, which facilitates distribution of the dye through the thickness of the web, the web is moved (e.g., drawn, in the illustrated embodiment) through the application chamber 107 of the microwave system 101. The microwave system 101 is operated to direct microwave energy into the application chamber 107 for absorption by the dye (e.g., which in one embodiment suitably has an affinity for, or couples with, the microwave energy). The dye is thus heated rapidly, thereby substantially speeding up the rate at which at the dye becomes bound to the textile web (e.g., as opposed to conventional heating methods such as curing in an oven). The web is subsequently moved downstream of the microwave system 101 for subsequent post-processing, such as washing to remove any unbound dye, and other suitable post-processing steps.

In the illustrated embodiment, the textile web 23 is thus first subjected to ultrasonic energy to facilitate distribution of the dye through the web, and then subjected to microwave energy to facilitate enhanced (and expedited) binding of the dye into the web. While this combination of processes has been found to result in better binding of the dye into the web than omitting the ultrasonic vibration step and just applying the microwave energy to the web, it is understood that that in other embodiments the web may be subjected to the microwave energy after the dye application, thereby omitting the ultrasonic vibration step, without departing from the scope of this invention. In such an embodiment, it is contemplated that dye may be initially applied throughout the web by saturating the web (e.g., by dipping the web in a dye bath) or by other suitable dyeing techniques that do not involve applying ultrasonic energy directly to the web.

EXPERIMENT

An experiment was conducted to determine the effectiveness of the above process in which the dyed web is subjected first to ultrasonic vibration and then to microwave energy, and to compare this effectiveness to that of the above process without the ultrasonic vibration step (e.g., microwave only), and to a conventional process in which the dyed web is simply cured in an oven after being dyed (e.g., no ultrasonics or microwave). Assessment of these processes was based on the color intensity of the dye on both the front and back faces of the web after processing.

Color is commonly measured by using a spectrodensitometer, which measures reflected light and provides calorimetric data as will be described hereinafter. The light which is reflected in the visual range (i.e., having a wavelength of 400 nm to 700 nm) can be processed to give a numerical indication of the color. An example of such a device is the X-Rite 938 reflection spectrodensitometer available from X-Rite, Incorporated of Grandville, Mich. A suitable program for analyzing the data generated by this instrument is the X-Rite QA Master 2000 software available from X-Rite, Incorporated.

Color can be described generally in terms of three elements, hue, chroma (or saturation) and lightness (sometimes called value or brightness). Hue (h) is the perceived attribute of a specific color that fixes the color's spectrum position and classifies it as blue, green, red or yellow. Chroma describes the vividness or dullness of a color. It is a measurement of how close the color is to either gray (a mixture of all colors) or to the pure hue. Chroma (C) can be broken into two measurements: a—the measurement of the redness or greenness of the color; and b—the measurement of the yellowness or blueness of the color. The range for a is from −60 to 60, with the range segment from 0 to 60 indicating increasing saturation of red as you approach 60, and the range segment 0 to −60 indicating increasing saturation of green as you approach −60. Chroma is defined as $C=(a^2+b^2)^{1/2}$. Lightness is the luminous intensity of a color, or how close the color is to white or black and ranges in value from 0 (black) to 100 (white). All of these attributes can be determined using the aforementioned spectrodensitometer, and analyzed with the QA Master 2000 software.

For this experiment, a master roll of cotton web commercially available from Test Fabrics, Inc. of West Pittston, Pa., U.S.A. as Style No. 419—bleached, mercerized, combed broadcloth was used as the textile web. The web has a basis weight of about 120 grams per square meter and is approximately four inches (about 10.2 cm) wide.

A black ink, commercially available from Yuhan-Kimberly of South Korea under the designation 67584 11005582 Nano-Colorant Black 220 ml was used as the ink solution. The ink applicator was an electrometric air atomization spray applicator nozzle commercially available as Spraymation Electromatic Air Atomized Applicator Head, Model 79200 from Spraymation of Fort Lauderdale, Fla. The ink was pumped into this nozzle using a Masterflex L/S-Computerized drive pump, Model number 7550-10 available from Cole Parmer Instrument Company. The pump was manufactured by Barnant Company of Barrington, Ill. The applicator was operated at a rate of about 35 grams/square meter.

For the ultrasonic vibration system, the various components that were used are commercially available from Dukane Ultrasonics of St. Charles, Ill., U.S.A as the following model numbers: power supply—Model 20A3000; converter—Model 110-3123; booster—Model 2179T; and horn Model 11608A. In particular, the horn had a thickness at its connection end of approximately 1.5 inches (3.81 cm), a thickness at its terminal end of approximately 0.5 inches (1.27 cm), a width of about 6.0 inches (15.24 cm) and a length (e.g., height in the illustrated embodiment) of about 5.5 inches (13.97 cm). The contact surface defined by the terminal end of the horn was flat, resulting in a contact surface length (e.g., approximately equal to the thickness of the horn at its terminal end) of about 0.5 inches (1.27 cm).

The microwave system used was similar to that described above and illustrated in FIG. 5 and operated by a power source commercially available as National Electronics Model GEN6KW480 from National Electronics of LaFox, Ill. and capable of delivering up to 6 KW of power. The resonant cavity of the microwave system had a depth (i.e., in the machine direction of movement of the web through the cavity) of about 3.5 inches (8.9 cm).

Three different processes were tested for this experiment: 1) a control in which the web was subjected to oven curing instead of ultrasonic vibration and microwave energy, 2) a process in which the web was subjected to microwave energy but not ultrasonic vibration, and 3) a process in which the web was subjected to both ultrasonic vibration and microwave energy. For each process, the master web, in rolled form, was placed on an unwind roll and unrolled and drawn past the ultrasonic vibration system and through the microwave system in an open configuration by a suitable wind roll and drive mechanism at a feed rate of about 4 ft./min. (about 1.2 meters/min.). Before the web reached the ultrasonic vibration system, the dye solution was sprayed by the dye applicator onto the face of the web that faces away from the ultrasonic vibration system (referred to further herein as the front face of the web).

The opposite face of the web (i.e., the face that is opposite that on which the dye was sprayed—referred to further herein as the back face of the web) was then drawn over the contact surface of the ultrasonic vibration system (e.g., in direct contact therewith). This resulted in a dwell time of the web on the contact surface of the ultrasonic vibration system of about 0.63 seconds. A uniform tension of approximately one pound per inch of web width was applied to the web. The approach and departure angles of the web relative to the longitudinal axis of the ultrasonic vibration system were each about 20 degrees. The web was subsequently drawn through the resonant cavity of the microwave system and then to the wind roll.

At least about 20 feet of the master roll of web material was run in accordance with each process to be tested. Once a particular process run was completed, a representative three foot sample of the dyed web was cut from the processed web and the L, a and b values of the sample was measured as described previously for both the front and back faces of the web. The web sample was then hand washed in a one gallon bath of detergent mixture comprised of 99.9% by volume of water and 0.1% by volume detergent (available from Procter and Gamble of Cincinnati, Ohio under the tradename Joy) to remove unbound dye from the web sample. The bath was intermittently dumped and refilled with a clean detergent solution until little or no dye washed out of the web sample. The L, a and b values for the front and back faces of the web were again measured after washing. Using the pre-washed color data as a reference, a "ΔE" value was determined as follows:

$$\Delta E=(\Delta L^2+\Delta a^2+\Delta b^2)^{1/2}$$

For the control process both the ultrasonic vibration system and the microwave system were turned off. The web sample cut from the dyed web was placed in an oven at 180 degrees Celsius for a period of three minutes prior to taking the pre-wash color data measurements. For the second process, the ultrasonic vibration system was turned off while the microwave system was operated at 2,450 MHz and an absorbed power of 200 watts. The third web was processed with the ultrasonic vibration system operating at 20 kHZ and the microwave system operated at 2,450 kHZ and an absorbed power of 200 watts.

The results of the experiment are summarized in the table below.

| Process Description | ΔE | L (after wash) |
|---|---|---|
| Control | | |
| Front Face | 1.25 | 22.73 |
| Back Face | 2.05 | 28.89 |
| Microwave Only | | |
| Front Face | 4.01 | 26.53 |
| Back Face | 2.10 | 30.33 |
| Ultrasonic/Microwave | | |
| Front Face | 1.12 | 23.69 |
| Back Face | 0.86 | 22.70 |

Focusing first on the lightness L, the dye was a black dye so the nearer to zero the lightness L is, the more "black" the respective face of the web appears. As is readily seen from the control, the back face (the face to which the dye solution was not applied) has a higher lightness L than the front face (to which the dye was initially applied), which means that the dye solution did not distribute well through the web from the front face to the back face of the web. The same is true for the specimen subjected only to the microwave energy. In contrast, for the specimen subjected to ultrasonic vibration the dye was more adequately pulled through the web to the back face thereof, as indicated by the nearly equal lightness values for the front and back faces of the web.

The ΔE value provides an indication of the effectiveness of the tested processes for binding the dye into the respective web specimens. That is, because the ΔA is based on the difference of the L, a and b values taken before and after washing, a positive ΔE means that dye was washed away by the washing process, thereby slightly fading or rendering less intense the appearance of the black dye. For the web specimen that was subjected only to microwave energy (e.g., and not ultrasonic energy), the ΔE was higher that it was for the control web specimen. Thus, subjecting the web only to microwave energy does not itself assure a better binding of the dye into the web. Subjecting the web to ultrasonic energy before the microwave energy, however, resulted in a lower ΔE than for the control process, particularly on the back face of the web. This indicates that the combination of the ultrasonic energy with the microwave energy provides and enhanced binding of the dye into the web during processing.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A process for dyeing a textile web, said textile web having a first face and a second face opposite the first face, said method comprising:

applying dye to the textile web, wherein the dye has a dielectric loss factor at 900 MHz and 22 degrees Celsius of at least about 5;

moving the web in an open configuration thereof over a contact surface of an ultrasonic vibration system with the textile web in direct contact with the contact surface of the ultrasonic vibration system;

operating the ultrasonic vibration system to impart ultrasonic energy to said textile web to facilitate the distribution of dye throughout the web;

moving the web in its open configuration through a microwave application chamber of a microwave system subsequent to imparting ultrasonic energy to said web, wherein the web is moved through the microwave application chamber at a rate relative to a microwave application chamber length to define a dwell time of the web within the chamber in the range of about 0.0002 seconds to about 3 seconds; and operating the microwave system to impart microwave energy to the web in the microwave application chamber to facilitate binding of the dye to the web.

2. The process set forth in claim 1 wherein the step of applying dye to the textile web comprises applying dye to the first face of the web other than by saturating the web.

3. The process set forth in claim 2 wherein the step of moving the web over the contact surface of an ultrasonic vibration system comprises moving said web of said contact surface with the second face of said web in direct contact with said contact surface of the ultrasonic vibration system.

4. The process set forth in claim 1 wherein the ultrasonic vibration system has a longitudinal axis, the textile web being moved in a machine direction from a location upstream from the contact surface of the ultrasonic vibration system into contact with the contact surface of the ultrasonic vibration system, said movement of the web in the machine direction being along an approach angle relative to said longitudinal axis of the ultrasonic vibration system, said approach angle being in the range of about 1 to about 89 degrees.

5. The process set forth in claim 4 wherein the approach angle is in the range of about 10 to about 45 degrees.

6. The process set forth in claim 4 wherein the textile web is further moved in the machine direction along a departure angle relative to the longitudinal axis of the ultrasonic vibration system from said contact of the web with the contact surface of the ultrasonic vibration system to a location downstream from said contact surface of the ultrasonic vibration system, said departure angle being in the range of about 1 to about 89 degrees.

7. The process set forth in claim 1 wherein the textile web has a width, the process further comprising holding the textile web in uniform tension across the width of the textile web at least at a portion of said textile web in direct contact with the contact surface of the ultrasonic vibration system, said tension being in the range of about 0.025 to about 3 pounds per inch of width of the textile web.

8. The process set forth in claim 1 wherein the ultrasonic vibration system is vibrated at a frequency in the range of about 20 kHz to about 40 kHz.

9. The process set forth in claim 1 wherein the step of operating the ultrasonic vibration system comprises supplying a power input to said system, the power input being in the range of about 0.5 kW to about 2 kw.

10. The process set forth in claim 1 wherein the textile web has a width, the ultrasonic vibration system comprising an ultrasonic horn having a terminal end defining said contact surface, said terminal end of the ultrasonic horn having a width that is approximately equal to or greater than the width of the web, the step of moving the web in an open configuration thereof over the contact surface of an ultrasonic vibration system comprising moving the web lengthwise over the contact surface of the ultrasonic vibration system with the terminal end of the ultrasonic vibration system oriented to extend widthwise across the width of the web with the contact surface in direct contact with the web.

11. The process set forth in claim 1 wherein the step of operating the microwave system comprises operating the microwave system at a frequency in the range of about 900 MHz to about 5,800 MHz.

12. The process set forth in claim 1 wherein the step of operating the microwave system comprises operating the microwave system at a power input in the range of about 1,500 watts to about 6,000 watts.

13. The process set forth in claim 1 wherein the step of applying dye to the textile web comprises applying a dye having a dielectric loss factor at 900 MHz and 22 degrees Celsius of at least about 10 to the textile web.

14. The process set forth in claim 13 wherein the step of applying dye to the textile web comprises applying a dye having a dielectric loss factor at 900 MHz and 22 degrees Celsius of at least about 14 to the textile web.

15. The process set forth in claim 1 wherein the step of applying dye to the textile web comprises applying a dye having a dielectric loss factor at 2,450 MHz and 22 degrees Celsius of at least about 10 to the textile web.

16. The process set forth in claim 15 wherein the step of applying dye to the textile web comprises applying a dye having a dielectric loss factor at 2,450 MHz and 22 degrees Celsius of at least about 15 to the textile web.

17. A process for dyeing a textile web, said textile web having a first face, a second face opposite the first face and a thickness from said first face to said second face, said method comprising:

applying dye to the textile web throughout the thickness thereof, wherein the dye has a dielectric loss factor at 900 MHz and 22 degrees Celsius of at least about 5;

moving the web in an open configuration thereof through a microwave application chamber of a microwave system subsequent to applying dye to the web, wherein the web is moved through the microwave application chamber at a rate relative to a microwave application chamber length to define a dwell time of the web within said chamber in the range of about 0.0002 seconds to about 3 seconds; and operating the microwave system to impart microwave energy to the web in the microwave application chamber to facilitate binding of the dye to the web.

18. The process set forth in claim 17 wherein the step of operating the microwave system comprises operating the microwave system at a frequency in the range of about 900 MHz to about 5,800 MHz.

19. The process set forth in claim 17 wherein the step of applying dye to the textile web comprises applying a dye having a dielectric loss factor at 900 MHz and 22 degrees Celsius of at least about 10 to the textile web.

20. The process set forth in claim 19 wherein the step of applying dye to the textile web comprises applying a dye having a dielectric loss factor at 900 MHz and 22 degrees Celsius of at least about 14 to the textile web.

21. The process set forth in claim 17 wherein the step of applying dye to the textile web comprises applying a dye having a dielectric loss factor at 2,450 MHz and 22 degrees Celsius of at least about 10 to the textile web.

22. The process set forth in claim 21 wherein the step of applying dye to the textile web comprises applying a dye having a dielectric loss factor at 2,450 MHz and 22 degrees Celsius of at least about 15 to the textile web.

23. The process set forth in claim 17 wherein the step of operating the microwave system comprises operating the microwave system at a power input in the range of about 1,500 watts to about 6,000 watts.

24. A process for dyeing a textile web, said textile web having a first face and a second face opposite the first face, said method comprising:

applying dye to the textile web, wherein said dye has a dielectric loss factor at 900 MHz and 22 degrees Celsius of at least about 10 and a dielectric loss factor at 2,450 MHz and 22 degrees Celsius of at least about 15;

moving the web in an open configuration thereof over a contact surface of an ultrasonic vibration system with the textile web in direct contact with the contact surface of the ultrasonic vibration system;

operating the ultrasonic vibration system to impart ultrasonic energy to said textile web to facilitate the distribution of dye throughout the web;

moving the web in its open configuration through a microwave application chamber of a microwave system subsequent to imparting ultrasonic energy to said web, wherein the web is moved through the chamber at a rate relative to a microwave application chamber length to define a dwell time of the web within said chamber in the range of about 0.0002 seconds to about 3 seconds; and operating the microwave system to impart microwave energy to the web in the microwave application chamber to facilitate binding of the dye to the web.

25. A process for dyeing a textile web, said textile web having a first face, a second face opposite the first face and a thickness from said first face to said second face, said method comprising:

applying dye to the textile web throughout the thickness thereof, wherein said dye has a dielectric loss factor at 900 MHz and 22 degrees Celsius of at least about 5 and a dielectric loss factor at 2,450 MHz and 22 degrees Celsius of at least about 10;

moving the web in an open configuration thereof through a microwave application chamber of a microwave system subsequent to applying dye to the web, wherein the web is moved through the microwave application chamber at a rate relative to a microwave application chamber length to define a dwell time of the web within said chamber in the range of about 0.0002 seconds to about 3 seconds;

and operating the microwave system to impart microwave energy to the web in the microwave application chamber to facilitate binding of the dye to the web.

* * * * *

UNITED STATES PATENT AND TRADEMARK OFFICE

CERTIFICATE OF CORRECTION

PATENT NO. : 8,182,552 B2
APPLICATION NO. : 11/777128
DATED : May 22, 2012
INVENTOR(S) : Robert Allen Janssen et al.

It is certified that error appears in the above-identified patent and that said Letters Patent is hereby corrected as shown below:

In the Specification

In Column 18, Line 55, delete "ΔA" and insert -- ΔE -- therefor.

Signed and Sealed this
Twelfth Day of May, 2015

Michelle K. Lee

Michelle K. Lee
*Director of the United States Patent and Trademark Office*